US009098049B2

(12) United States Patent
Asaoka et al.

(10) Patent No.: US 9,098,049 B2
(45) Date of Patent: Aug. 4, 2015

(54) CLEANING DEVICE, PROCESS CARTRIDGE INCORPORATING SAME, AND IMAGE FORMING APPARATUS INCORPORATING SAME

(71) Applicants: Akira Asaoka, Kanagawa (JP); Toshiya Sato, Kanagawa (JP); Norio Kudoh, Kanagawa (JP); Hiroyuki Uenishi, Kanagawa (JP); Fumihito Itoh, Miyagi (JP)

(72) Inventors: Akira Asaoka, Kanagawa (JP); Toshiya Sato, Kanagawa (JP); Norio Kudoh, Kanagawa (JP); Hiroyuki Uenishi, Kanagawa (JP); Fumihito Itoh, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/452,666

(22) Filed: Aug. 6, 2014

(65) Prior Publication Data

US 2015/0063887 A1 Mar. 5, 2015

(30) Foreign Application Priority Data

Aug. 28, 2013 (JP) ..... 2013-176994

(51) Int. Cl.
*G03G 21/10* (2006.01)
*G03G 21/00* (2006.01)

(52) U.S. Cl.
CPC ..... *G03G 21/105* (2013.01); *G03G 21/0035* (2013.01); *G03G 2221/0005* (2013.01)

(58) Field of Classification Search
CPC ..... G03G 21/0035; G03G 2221/001; G03G 2221/0005
See application file for complete search history.

(56) References Cited

U.S. PATENT DOCUMENTS

| | | | | |
|---|---|---|---|---|
| 8,131,170 | B2 * | 3/2012 | Kurz | 399/35 |
| 8,190,078 | B2 * | 5/2012 | Tawada | 399/358 |
| 8,948,626 | B2 * | 2/2015 | Ishii | 399/34 |
| 2009/0185842 | A1 | 7/2009 | Hatori et al. | |
| 2010/0080600 | A1 | 4/2010 | Okamoto et al. | |
| 2012/0237230 | A1 | 9/2012 | Karasawa et al. | |
| 2012/0328332 | A1 | 12/2012 | Kosuge et al. | |
| 2014/0093295 | A1 | 4/2014 | Kojima et al. | |
| 2014/0169852 | A1 | 6/2014 | Satoh et al. | |

FOREIGN PATENT DOCUMENTS

| | | |
|---|---|---|
| JP | 10-186857 | 7/1998 |
| JP | 2005-128203 | 5/2005 |

OTHER PUBLICATIONS

U.S. Appl. No. 14/168,308, filed Jan. 30, 2014.

* cited by examiner

*Primary Examiner* — Gregory H Curran
(74) *Attorney, Agent, or Firm* — Harness, Dickey & Pierce, P.L.C.

(57) ABSTRACT

A cleaning device, which is included in a process cartridge or an image forming apparatus, includes a cleaning member including a brush rotary body that is disposed in contact with an image carrier provided in an image forming apparatus and that removes toner on the image carrier and holds the toner thereon, a toner conveying rotary body to collect and convey the toner removed by the cleaning member, a flicker contacting the cleaning member to flick off the toner held on the cleaning member, and an agitator that has a free end contacting the toner conveying rotary body and vibrating due to rotation of the toner conveying rotary body. The agitator further has a trajectory being formed between the opening and the toner conveying rotary body by movement of the free end. Alternatively, the free end of the agitator is disposed facing the flicker.

20 Claims, 11 Drawing Sheets

CLEANING DEVICE, PROCESS CARTRIDGE INCORPORATING SAME, AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2013-176994, filed on Aug. 28, 2013 in the Japan Patent Office, the entire disclosure of which is hereby incorporated by reference herein.

BACKGROUND

1. Technical Field

This disclosure relates to a cleaning device, a process cartridge incorporating the cleaning device and an image forming apparatus incorporating the cleaning device.

2. Related Art

Electrophotographic image forming apparatuses typically include a cleaning device having a cleaning brush and a cleaning blade therein. Residual toner that is cleaned and collected by the cleaning brush and the cleaning blade from a photoconductor is regarded as waste toner and is conveyed by a toner conveying screw provided in the cleaning device to a waste toner container. For example, the toner cleaned by the cleaning brush is flicked off by the flicker in a toner conveying screw direction and is discharged as the waste toner by the toner conveying screw.

In a device using the toner, a spiral-shaped or coil-shaped toner conveying member is rotated to contact and vibrate an agitator in order to prevent toner blocking. Specifically, the agitator vibrates to flick off the toner accumulated between conveying members by vibration of the agitator, thereby preventing occurrence of toner blocking caused by cohesion of toner to the toner conveying member.

SUMMARY

At least one embodiment provides a cleaning device including a cleaning member including a brush rotary body that is disposed in contact with an image carrier provided in an image forming apparatus and that removes toner on the image carrier and holds the toner thereon, a toner conveying rotary body to collect and convey the toner removed by the cleaning member, a flicker contacting the cleaning member to flick off the toner held on the cleaning member and having an opening, and an agitator that has a free end contacting the toner conveying rotary body and vibrating due to rotation of the toner conveying rotary body and has a trajectory being formed between the opening and the toner conveying rotary body by movement of the free end.

Further, at least one embodiment provides a process cartridge that is detachably attachable to an apparatus body of an image forming apparatus and that includes the above-described cleaning device and at least one of the image carrier to form an image on a surface thereof, a charger to uniformly charge the image carrier, and a development device to develop the image on the image carrier charged by the charger.

Further, at least one embodiment provides an image forming apparatus including an image forming device to form an image on a recording medium, and the above-described cleaning device included in the image forming device.

Further, at least one embodiment provides a cleaning device including a cleaning member including a brush rotary body that is disposed in contact with an image carrier provided in an image forming apparatus and that removes toner on the image carrier and holds the toner thereon, a toner conveying rotary body to collect and convey the toner removed by the cleaning member, a flicker contacting the cleaning member to flick off the toner held on the cleaning member, and an agitator that has a free end contacting the toner conveying rotary body, vibrating due to rotation of the toner conveying rotary body, and being disposed facing the flicker.

Further, at least one embodiment provides a process cartridge that is detachably attachable to an apparatus body of an image forming apparatus and that includes the above-described cleaning device and at least one of the image carrier to form an image on a surface thereof, a charger to uniformly charge the image carrier, and a development device to develop the image on the image carrier charged by the charger.

Further, at least one embodiment provides an image forming apparatus including an image forming device to form an image on a recording medium, and the above-described cleaning device included in the image forming device.

Further, at least one embodiment provides a cleaning device including a cleaning member to remove toner on an image carrier provided in an image forming apparatus and to clean a surface of the image carrier, a toner conveying rotary body to collect and convey the toner removed by the cleaning member, and an agitator that contacts the toner conveying rotary body and vibrates due to rotation of the toner conveying rotary body. The agitator includes a sliding surface that contacts the toner conveying rotary body. Further, the sliding surface of the agitator is either attached with a wear resistance sheet different from a material of the agitator or coated with a wear resistance material different from the material of the agitator.

Further, at least one embodiment provides a process cartridge that is detachably attachable to an apparatus body of an image forming apparatus and that includes the above-described cleaning device and at least one of the image carrier to form an image on a surface thereof, a charger to uniformly charge the image carrier, and a development device to develop the image on the image carrier charged by the charger.

Further, at least one embodiment provides an image forming apparatus including an image forming device to form an image on a recording medium, and the above-described cleaning device included in the image forming device.

BRIEF DESCRIPTION OF THE DRAWINGS

A more complete appreciation of the disclosure and many of the advantages thereof will be obtained as the same becomes better understood by reference to the following detailed description when considered in connection with the accompanying drawings, wherein.

DETAILED DESCRIPTION

Figure 1:
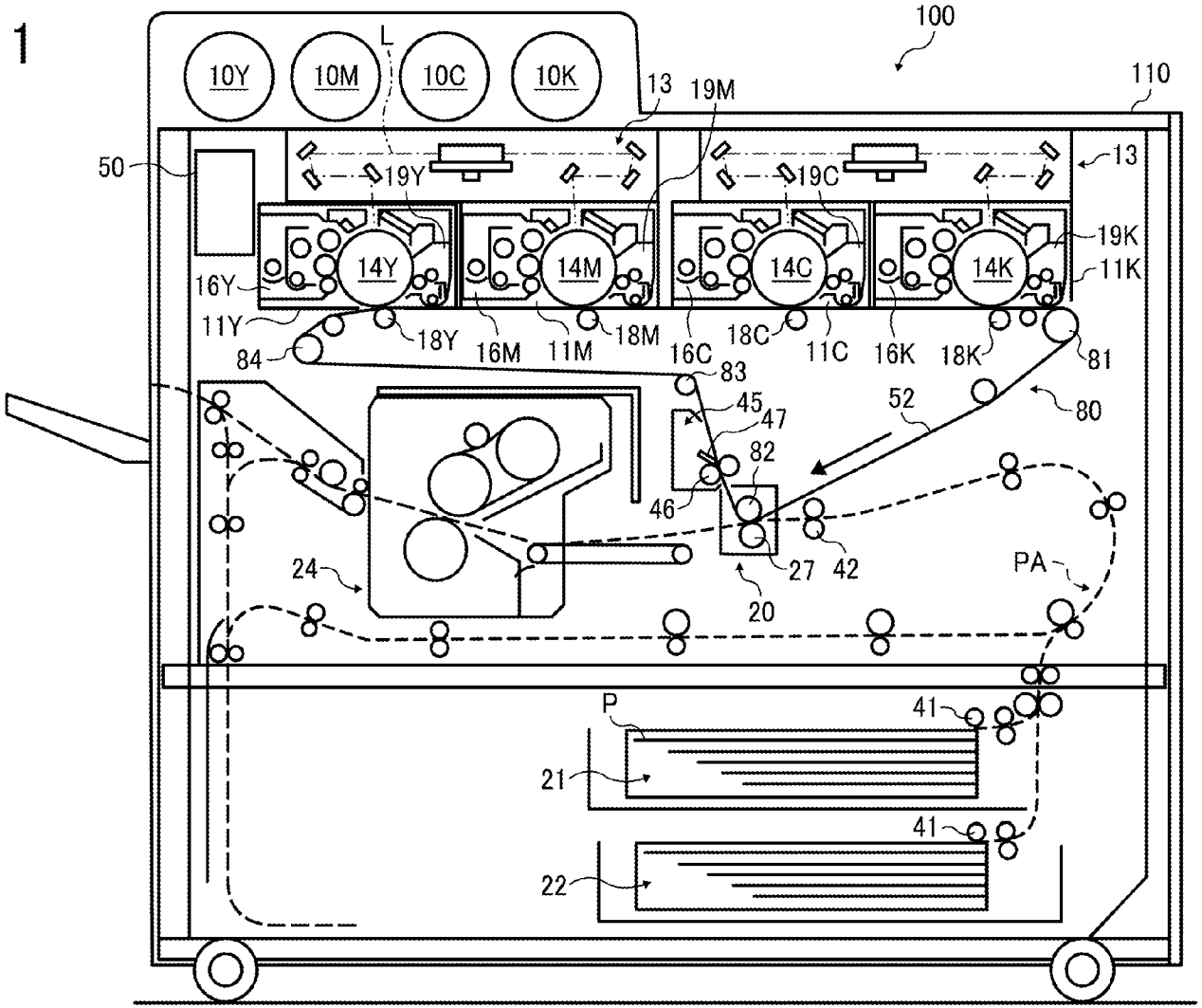
FIG. 1 is a front view illustrating a schematic configuration of an image forming apparatus including a cleaning device according to an embodiment.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the disclosure.

The terminology used herein is for describing particular embodiments and is not intended to be limiting of exemplary embodiments of the disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the disclosure.

The disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments are described.

Now, a description is given of a whole configuration and functions of an image forming apparatus 100 including a cleaning device 19 according to the present embodiment with reference to FIG. 1.

FIG. 1 is a front view illustrating a schematic configuration of an image forming apparatus 100 according to an embodiment and the cleaning device 19 incorporated therein.

The image forming apparatus 100 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 100 is an electrophotographic color printer that forms color and monochrome toner images on recording media by electrophotography.

Further, it is to be noted in the following embodiments that the term "sheet" is not limited to indicate a paper material but also includes OHP (overhead projector) transparencies, OHP film sheets, coat paper, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

As illustrated in FIG. 1, the image forming apparatus 100 includes an intermediate transfer device 80 at a substantially center of an apparatus body 110.

The intermediate transfer device 80 includes an intermediate transfer belt 52. The intermediate transfer belt 52 functions as an image carrier and an intermediate transfer body having an endless form. The intermediate transfer belt 52 is wound about multiple support rollers with tension in a loop.

The multiple support rollers include a drive roller 81, a secondary transfer backup roller 82, driven rollers 83 and 84, and four primary transfer rollers 18Y, 18C, 18M, and 18K. The drive roller 81 rotates clockwise in FIG. 1. The secondary transfer backup roller 82 is an opposed roller disposed facing a secondary transfer roller 27. The suffixes "Y", "C", "M", and "K" provided after the primary transfer rollers 18 represent that the respective primary transfer rollers are for producing yellow, cyan, magenta, and black images.

The intermediate transfer belt 52 is stretched around the drive roller 81, the secondary transfer backup roller 82, the driven rollers 83 and 84, and the primary transfer rollers 18Y, 18C, 18M, and 18K in a substantially inverted triangle shape.

Process cartridges 11Y, 11C, 11M, and 11K (hereinafter, also referred to as a process cartridge 11) are disposed along a horizontal direction above a stretched surface of the intermediate transfer belt 52. The stretched surface of the intermediate transfer belt 52 is equivalent to the bottom line of the inverted triangle of the intermediate transfer belt 52. The process cartridges 11Y, 11C, 11M, and 11K function as image forming devices.

The process cartridge 11Y accommodates yellow image forming parts and components. Yellow toner images formed in the process cartridge IIY are transferred onto a surface of the intermediate transfer belt 52. Similarly, the process cartridges 11C, 11M, and 11K accommodate magenta, cyan, and black image forming parts and components, and magenta, cyan, and black toner images formed in the process cartridges 11C, 11M, and 11K are transferred onto the surface of the intermediate transfer belt 52 at respective primary transfer positions where the magenta, cyan, and black toner images face the primary transfer rollers 18C, 18M, and 18K, respectively. The respective color toner images are overlaid on the surface of the intermediate transfer belt 52 to be a composite toner image. The composite toner image is conveyed to a secondary transfer part 20 as the intermediate transfer belt 52 endlessly moves in a loop.

In FIG. 1, an exposure device pair (optical writing device) 13 is disposed above the process cartridges 11Y, 11C, 11M, and 11K. The exposure device pair 13 includes an exposure device for yellow and magenta images and an exposure device for cyan and black images to emit respective laser light beams L based on image data to respective photoconductor drums 14Y, 14C, 14M, and 14K, each functioning as an image carrier. The exposure device pair 13 receives data of each color based on image data of an original document transmitted from a scanner to a controller 50. Then, a laser controller drives four semiconductor lasers to emit the four laser light beams L. Thereafter, the laser light beams L scan the photoconductor drums 14Y, 14C, 14M, and 14K (hereinafter, also referred to as a photoconductor drum 14) of the process cartridges 11Y, 11C, 11M, and 11K to write yellow, cyan, magenta, and black electrostatic latent images on respective outer circumferential surfaces of the photoconductor drums 14Y, 14C, 14M, and 14K.

In FIG. 1, the image forming apparatus 100 further includes the secondary transfer part 20, sheet feeding devices 21 and 22, a fixing device 24, and toner bottles 10Y, 10C, 10M, and 10K.

The secondary transfer part 20 secondarily transfers a full-color toner image formed on the intermediate transfer belt 52 onto a recording medium P serving as a sheet-shaped recording medium.

Each of the sheet feeding devices 21 and 22 accommodates a stack of recording media including the recording medium P therein.

The fixing device 24 fixes unfixed toner image to the recording medium P.

Figure 2:
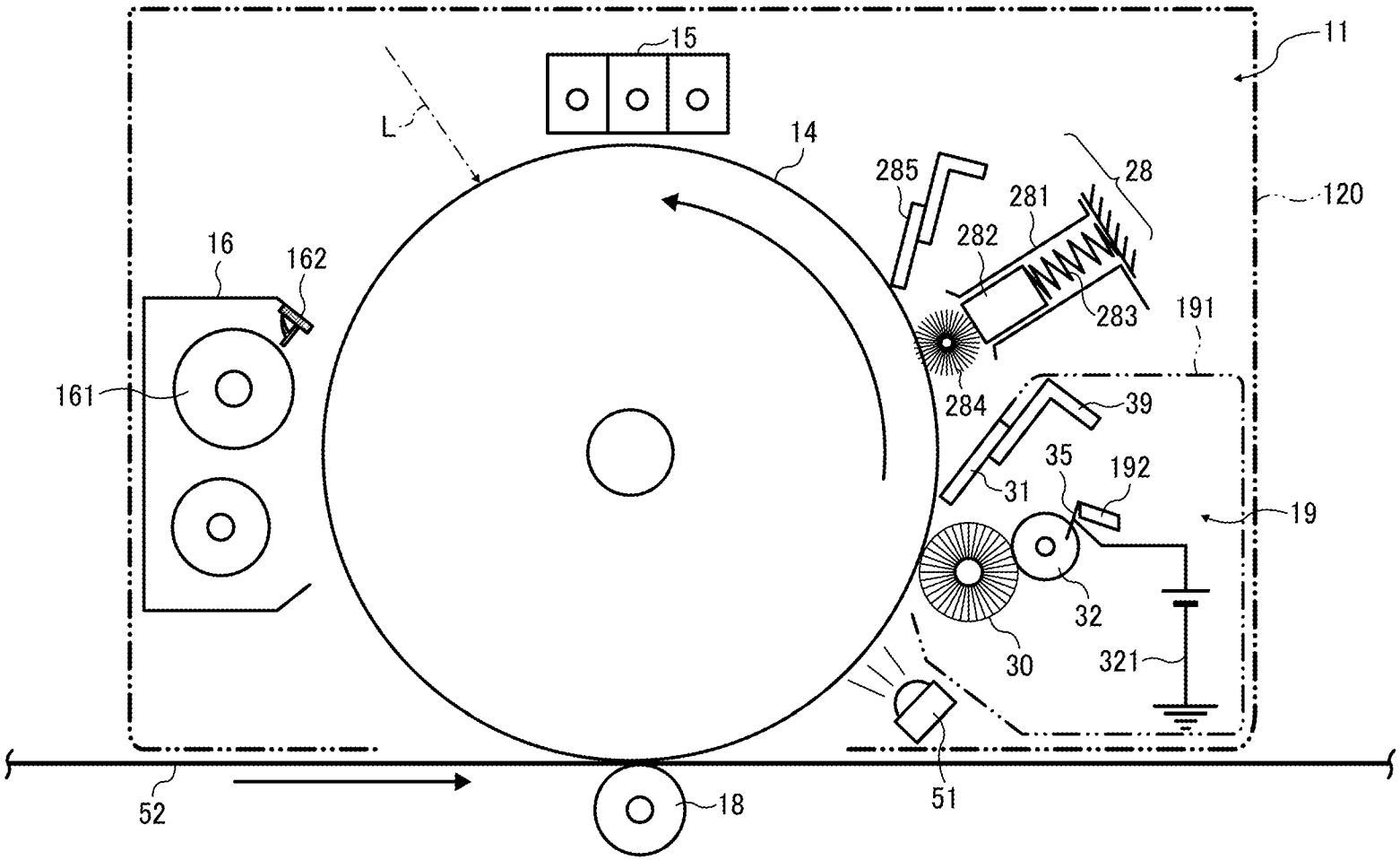
FIG. 2 is a cross-sectional view illustrating a process cartridge included in the image forming apparatus and adjacent devices.

Next, a description is given of a structure and functions of the process cartridge 11 with reference to FIGS. 1 and 2. Since the elements or components of the process cartridges 11Y, 11C, 11M, and 11K are identical in structure and functions except for toner colors, the description of the process cartridge 11 can be applied to any one of the process cartridges 11Y, 11C, 11M, and 11K.

FIG. 2 is a cross-sectional view illustrating the process cartridge 11 included in the image forming apparatus 100 and adjacent devices. To make the drawing concise, a flicker 200 (refer to FIG. 4), an agitator 300 (refer to FIG. 4), and a conveying screw (refer to FIG. 3) are not illustrated in FIG. 2.

In FIGS. 1 and 2, the image forming apparatus 100 further includes a charger 15, a development device 16, a cleaning device 19, an electric discharging lamp 51, and a lubricant applicator 28 in the process cartridge 11. The charger 15 uniformly charges the surface of the photoconductor drum 14. The development device 16 develops an electrostatic latent image formed on the surface of the photoconductor drum 14 into a toner image. The cleaning device 19 collects residual toner remaining on the surface of the photoconductor drum 14. The electric discharging lamp 51 electrically discharges residual potential remaining on the surface of the photoconductor drum 14.

The photoconductor drum 14 and the devices and components disposed around the photoconductor drum 14 are supported by a casing 120 illustrated with a two-dot chain line in FIG. 2. The casing 120, the photoconductor drum 14 and the devices and components form the single process cartridge 11. The process cartridge 11 is detachably attachable to the apparatus body 110 integrally via the casing 120. By so doing, maintainability of the process cartridge 11 is enhanced.

Next, a description is given of image forming operations of the process cartridge 11.

Image data is transmitted from the scanner to the controller 50 to be separated into four colors. The image data of each color is converted into electric signals and transmitted to the exposure device pair 13. Then, the laser light beam L based on the image data converted into the electric signals are emitted to the photoconductor drum 14.

The photoconductor drum 14 rotates counterclockwise in FIG. 2 to uniformly charge the outer circumferential surface (hereinafter, also referred to as a surface) at a position where the photoconductor drum 14 faces the charger 15. The charged surface of the photoconductor drum 14 comes to face an irradiation position of the laser light beam L, where an electrostatic latent image corresponding to the image data is formed on the surface of the photoconductor drum 14.

The electrostatic latent image formed on the surface of the photoconductor drum 14 comes to a position facing the development device 16, so that the development device 16 develops the electrostatic latent image to a visible toner image. It is to be noted that toner in the developer contained in the development device 16 is mixed with toner supplied by a toner hopper and carriers by an agitating roller. The thus frictionally charged toner is supplied onto a development roller 161 together with the carrier. Thereafter, the toner held on the development roller 161 passes by a doctor blade 162 to be regulated in height, and comes to a position facing the photoconductor drum 14. At this position, the toner is attracted to the electrostatic latent image formed on the photoconductor drum 14. It is to be noted that the toner supplied by the toner hopper is supplied suitably as the toner in the development device 16 is consumed and that the toner consumption state in the development device 16 is detected by an optical sensor or a toner density sensor.

The surface of the photoconductor drum 14 with the toner image developed by the development device 16 then comes to a position facing the primary transfer roller 18. At this position, the toner image formed on the photoconductor drum 14 is primarily transferred onto the intermediate transfer belt 52.

After this primary transfer of the toner image onto the intermediate transfer belt 52, a small amount of toner that has not been transferred onto the intermediate transfer belt 52 remains on the surface of the photoconductor drum 14. Here, the electric discharging lamp 51 emits light to remove residual electrostatic potential remaining on the surface of the photoconductor drum 14 that has passed the primary transfer roller 18 so as to reset the potential. After the residual electric potential is removed, the surface of the photoconductor drum 14 having residual toner thereon reaches the cleaning device 19 according to the present embodiment.

The cleaning device 19 includes a container 191 illustrated with a two-dot chain line in FIG. 2. The container 191 contains a cleaning brush 30 and a metallic blade 35. The cleaning brush 30 is in contact with the photoconductor drum 14 and is positively charged. The metallic blade 35 is negatively charged by a charger 321. With this configuration of an electrostatic remover, the residual toner remaining on the photoconductor drum 14 is collected.

Residual toner unremoved by the cleaning brush 30 moves forward to the cleaning blade 31 disposed downstream from the cleaning brush 30 in a rotation direction of the photoconductor drum 14 as indicated by arrow in FIG. 2. The cleaning blade 31 is a urethane rubber (an elastic material) that functions as a cleaning member, and has a strip plate of a rectangular cross-section. The cleaning blade 31 is attached to the container 191 that is disposed close to the casing 120 via a supporting bracket 39 that serves as a blade supporting member. The cleaning blade 31 reliably scrapes and removes a relatively small amount of residual toner that has not been removed by the cleaning brush 30.

Figure 3:
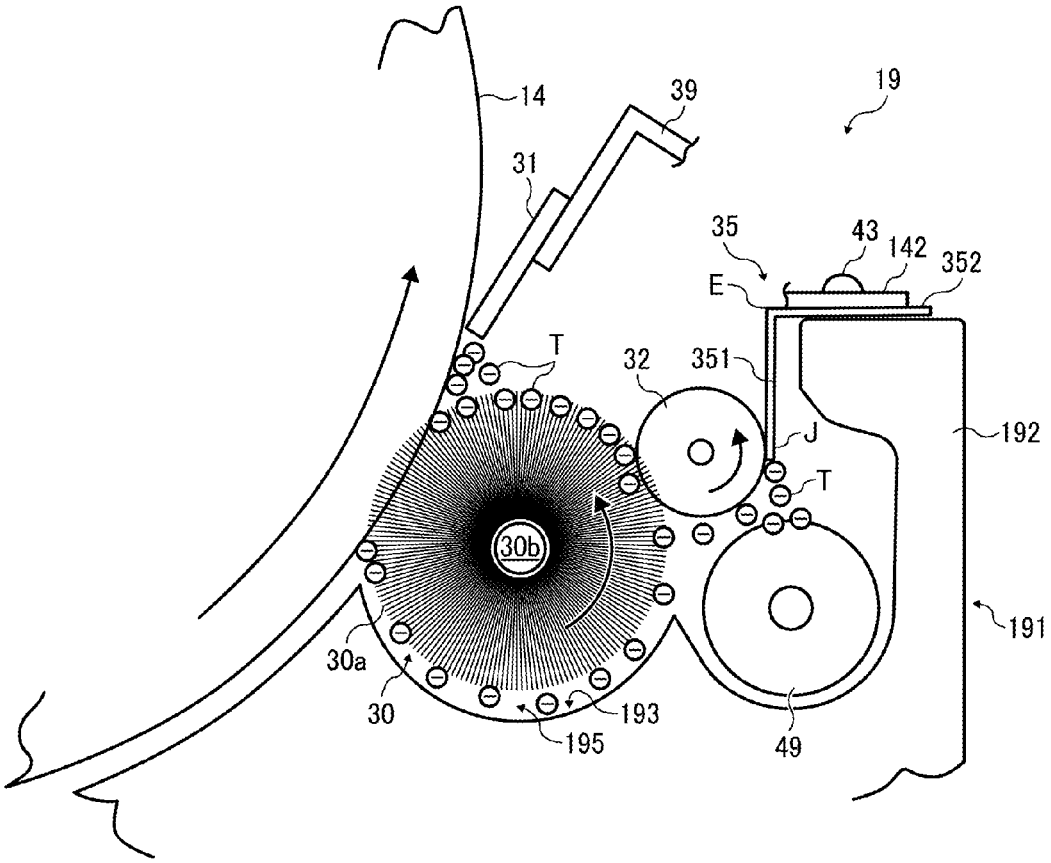
FIG. 3 is an enlarged cross-sectional view illustrating the cleaning device included in the process cartridge of FIG. 2.

The toner collected by the cleaning device 19 that includes the cleaning blade 31 is regarded as waste toner and conveyed toward a waste toner bottle along a waste toner conveying path via the conveyance screw 49 (see FIG. 3). A detailed configuration of the cleaning device 19 is described below.

It is to be noted that both the cleaning blade 31 and the supporting bracket 39 extend throughout a whole length in a longitudinal direction (or an axial direction) of the photoconductor drum 14 in the present embodiment. It is preferable that a portion where the cleaning blade 31 is supported by and fixed to the supporting bracket 39 is closely contacted to the photoconductor drum 14 through the whole length in the longitudinal direction of the photoconductor drum 14 so that residual toner that is flicked by the cleaning brush 30 cannot pass through the portion.

After the residual toner remaining on the surface of the photoconductor drum 14 is removed by the cleaning device 19, the lubricant applicator 28 applies wax functioning as lubricant (such as stearic acid amide) to the surface of the photoconductor drum 14, so that the outer surface of the photoconductor drum 14 is protected.

The lubricant applicator 28 includes a lubricant casing 281, a solid wax 282, a spring 283, and a rotary brush 284. The solid wax 282 is a stearic acid amide material. The solid wax 282 is relocatably disposed in the lubricant casing 281. The spring 283 is a compression spring that biases the wax 282 toward a direction in which the wax 282 projects to contact the surface of the photoconductor drum 14. The rotary brush 284 is linked to a motor and is rotated appropriately to apply wax powder scraped by its abutting end face in contact with a surface of the wax 282 to the surface of the photoconductor drum 14.

An application blade 285 is disposed at a position downstream from the rotary brush 284 in the rotation direction of the photoconductor drum 14. The application blade 285 regulates the wax powder to be attached uniformly on the outer surface of the photoconductor drum 14. This configuration provided with the application blade 285 works for protecting the surface of the photoconductor drum 14 by appropriately adjusting the thickness of a layer of wax powder scraped from the wax 282 and preventing the cleaning blade 31 on the side of the cleaning device 19, as described below.

As described above, the respective single color toner images formed by the process cartridges 11Y, 11C, 11M, and 11K are sequentially transferred and overlapped onto the intermediate transfer belt 52. Then, the color toner image primarily transferred onto the intermediate transfer belt 52 is conveyed to the secondary transfer part 20 as illustrated in FIG. 1 along with movement of the intermediate transfer belt 52.

The recording medium P is fed and conveyed to the secondary transfer part 20 according to the following operations. As illustrated in FIG. 1, one of the sheet feeding devices 21 and 22 of the image forming apparatus 100 is selected automatically or manually (through operation via a control device by a user). In the present embodiment, the sheet feeding device 21 disposed above the sheet feeding device 22 is selected. By driving a feed roller 41, one recording medium P of the recording media accommodated in the sheet feeding device 21 is fed into a sheet conveying path PA. After passing through the sheet conveying path PA, the recording medium P reaches a registration roller pair 42 and stops. Since the registration roller pair 42 rotates at a given timing, the recording medium P is fed toward the secondary transfer part 20 in synchronization with movement of the toner image on the intermediate transfer belt 52.

In the secondary transfer part 20, the toner image is transferred onto the recording medium P in the transfer process. After passing the secondary transfer part 20, the recording medium P is conveyed to the fixing device 24 via the sheet conveying path PA.

The fixing device 24 fuses and fixes the unfixed toner image formed on the recording medium P to the recording medium P by application of heat and pressure. The recording medium P having the fixed toner image thereon is discharged as an output image to the outside of the image forming apparatus 100.

It is to be noted that, when the intermediate transfer belt 52 after passing the secondary transfer part 20 reaches a belt cleaning device 45, a scraping blade 47 scrapes residual toner remaining on the surface of the intermediate transfer belt 52 at a position facing a guide roller 46 of the belt cleaning device 45. Here, the guide roller 46 applies a given tension to the intermediate transfer belt 52 and facilitates a scraping action of the scraping blade 47. It is to be noted that the scraping blade 47 has a shorter life than the intermediate transfer belt 52 and therefore is replaced suitably and timely before the life thereof is expired.

With the above-described operations, a series of image forming processes is finished.

Next, a description is given of a configuration of the cleaning device 19 that removes residual toner remaining on the surface of the photoconductor drum 14 of the process cartridge 11, with reference to FIGS. 1 through 3.

FIG. 3 is an enlarged cross-sectional view illustrating the cleaning device 19 included in the process cartridge 11 of FIG. 2. To make the drawing concise, the flicker 200 and the agitator 300 are not illustrated in FIG. 3.

As illustrated in FIGS. 1 through 3, the cleaning devices 19Y, 19M, 19C, and 19K (hereinafter, referred to as the cleaning device 19) remove residual toner on the respective surfaces of the photoconductor drums 14Y, 14M, 14C. and 14K (hereinafter, referred to as the photoconductor drum 14) to be collected to where the collected residual toner is stored.

As illustrated in FIG. 3, the cleaning device 19 includes the cleaning brush 30, a metallic roller 32, the metallic blade 35, the conveyance screw 49, and the cleaning blade 31. The cleaning brush 30 is a cleaning member that functions as a brush rotary body or a fabric rotary body, which contacts the surface of the photoconductor drum 14, removes residual toner from the surface of the photoconductor drum 14, and holds the collected residual toner therewith. The metallic roller 32 functions as a toner collecting rotary body that contacts the cleaning brush 30 and that collects toner held by the cleaning brush 30. The metallic blade 35 functions as a toner collecting member or a toner scraping member that contacts the metallic roller 32 and scrapes the toner attached to the metallic roller 32. The conveyance screw 49 functions as a waste toner conveying member or a toner conveying rotary body (hereinafter, also referred to as a conveying member) that collects and conveys waste toner removed by the cleaning brush 30 to a waste toner bottle. The toner conveying screw 49 is rotated by a drive motor that functions as a drive unit.

The cleaning blade 31 is disposed downstream from the cleaning brush 30 in the rotation direction of the photoconductor drum 14. The cleaning blade 31 functions as a cleaning blade member that contacts the photoconductor drum 14 and scrapes toner T slipped through the cleaning brush 30.

As illustrated in FIG. 3, the cleaning brush 30 rotates counterclockwise, which is the same rotation direction as the photoconductor drum 14. By so doing, the cleaning brush 30 removes residual toner remaining on the surface of the photoconductor drum 14 electrostatically and keeps the residual toner attached thereon. The metallic roller 32 disposed in contact with the cleaning brush 30 rotates counterclockwise in FIG. 3, so that the toner T held on an outer circumferential surface of the cleaning brush 30 is electrostatically attached and collected to the outer circumferential surface thereof. The metallic blade 35 elastically contacts the edge J to the surface of the metallic roller 32 to mechanically remove the toner T.

The cleaning brush 30 and the metallic roller 32 are rotatably supported by a pair of sidewalls 194*a* and 194*b* (refer to FIG. 10) provided with the container 191 extending in a direction perpendicular to the surface of the drawing and is disposed at the front and back of the drawing surface. The cleaning brush 30, the metallic roller 32, and the metallic blade 35 extend in an axial direction (a longitudinal direction) of the photoconductor drum 14. The cleaning brush 30 and the metallic roller 32 are rotatably connected to a drive motor functioning as a drive unit via drive transmission members such as gears.

The container 191 further includes an attaching portion 192 and a brush facing recess 193. The attaching portion 192 attaches and fixes the metallic blade 35 as described below. The brush facing recess 193 is disposed facing an outer circumference of the cleaning brush 30. Both the attaching portion and the brush facing recess 193 extend in an axial direction (a longitudinal direction) of the photoconductor drum 14. The container 191 is integrally formed with a suitable resin.

As described above, the cleaning brush 30, the metallic roller 32, and the metallic blade 35 are included in the container 191. The cleaning brush 30, the metallic roller 32, and the metallic blade 35 are surrounded by and disposed facing the cleaning blade 31, the supporting bracket 39, and the pair of sidewalls 194*a* and 194*b* at an upper space in the container 191.

Since the cleaning brush 30 rotates counterclockwise, the toner T faces the metallic roller 32 and the metallic blade 35 after having passed through a clearance 195 between the cleaning brush 30 and the brush facing recess 193 on the side of the attaching portion 192 of the container 191. Therefore, the scraped toner T can flow down to the conveyance screw 49 disposed directly below the metallic roller 32 and the metallic blade 35 easily, which can shorten the length of the toner removal path and prevent toner dispersion.

It is to be noted that, as the configuration of the present embodiment uses a negatively charged toner as described above, the cleaning brush 30, the metallic roller 32, and the metallic blade 35 are positively charged. By contrast, when a configuration that uses a positively charged toner is used, the cleaning brush 30, the metallic roller 32, and the metallic blade 35 are to be charged negatively.

Here, the characteristic values of the cleaning brush 30 and the metallic roller 32 of the cleaning device 19 are described. In FIG. 3, the cleaning brush 30 includes a bristle 30*a* that is a unit of bristles as brush fabric planted on the cleaning brush 30.

Cleaning Brush 30.

Material of Bristle Fiber: conductive polyester.

Diameter: 18 mm.

Length of Bristle Fiber: 5 mm.

Bite Amount to Photoconductor Drum 14: 1 mm.

Linear Velocity: 224 mm/sec to 246 mm/sec (contact with the photoconductor drum 14 in a counter direction).

Volume Resistivity (Electric Positivity) of Bristle (Original Thread): $10^8$ Ω·cm.

Brush Bristle Density: 20,000 bristles/inch$^2$.

Material of Shaft 30*b:* Free Cutting Steel (SUM).

The cleaning brush 30 is planted with the conductive polyester brush fabric around a shaft 30*b* of a free cutting steel (SUM).

Metallic Roller 32: Collection Roller

Material: Stainless Steel (SUS).

Diameter: 10 mm.

Velocity: 111 mm/sec to 121 mm/sec.

Voltage: 1200V. However, the voltage value is variable on the basis of control (400V-1200V).

The above-described voltage is applied via the charger 321 and the metallic blade 35. The metallic blade 35 is disposed at a position facing the cleaning brush 30 via the metallic roller 32.

It is to be noted that the linear velocity of the cleaning brush 30 and the linear velocity of the metallic roller 32 are different according to the process linear velocity.

Metallic Blade 35

Material: Phosphor Bronze Thin Plate.

Thickness: Thin, bent plate having t=0.15 mm is used. Thin plate having t=0.1 mm through 0.6 mm can also be applied. The metallic blade 35 is disposed facing the metallic roller 32 and extending along a longitudinal direction of the metallic roller 32. The metallic blade 35 is fixed to the attaching portion 192 on the side of the container 191 of the cleaning device 19 with screws 43 via a fixing member 142.

Here, the metallic blade 35 is bent to a cross-sectional L shape as illustrated in FIG. 3 and extends linearly in a direction perpendicular to the cross section (the drawing sheet) of the same L shape. One side of a bent portion E in the cross-sectional L shape is formed as an edge side part 351 and the other side thereof is formed as a fixed side part 352. The edge side part 351 has an edge J and is attached such that the edge J uniformly contacts an outer surface of the metallic roller 32.

Figure 4:
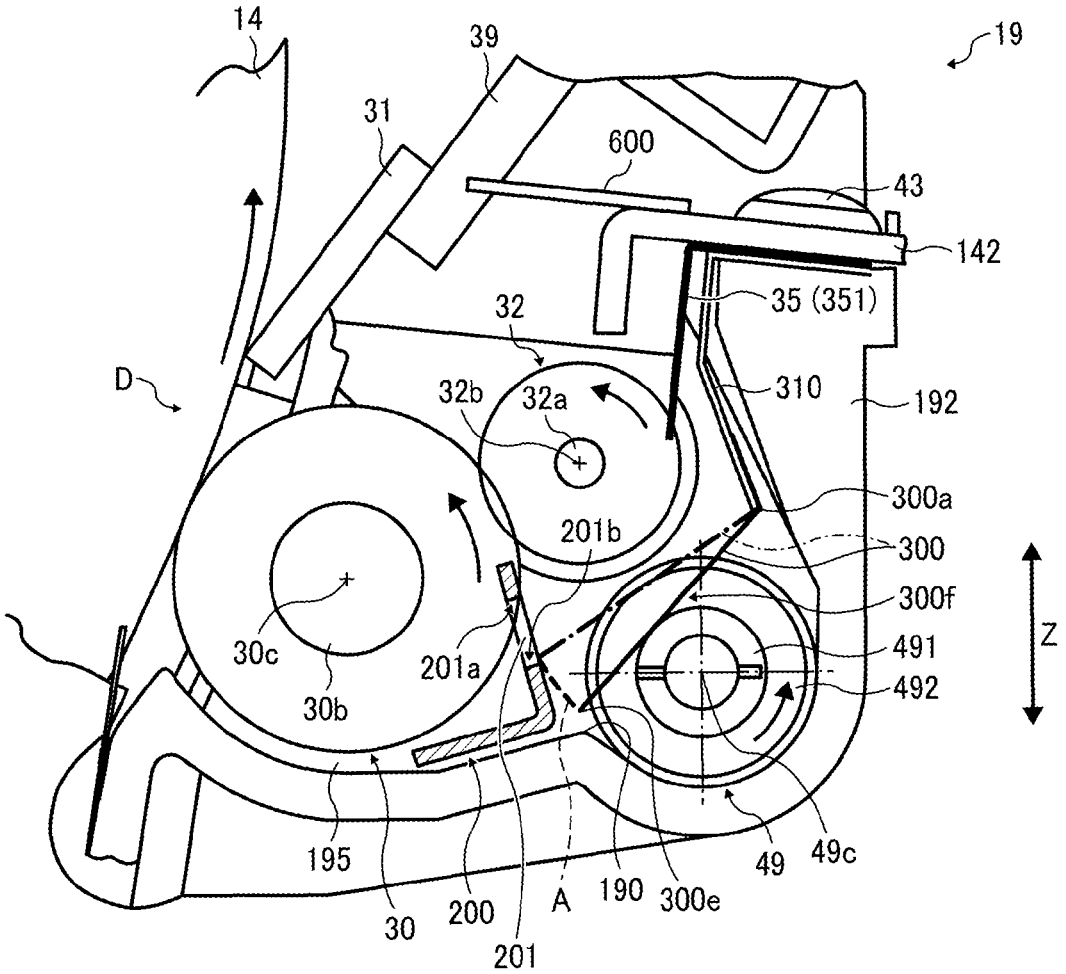
FIG. 4 is an enlarged cross-sectional view illustrating a schematic configuration of the cleaning device of FIG. 3.
Figure 5:
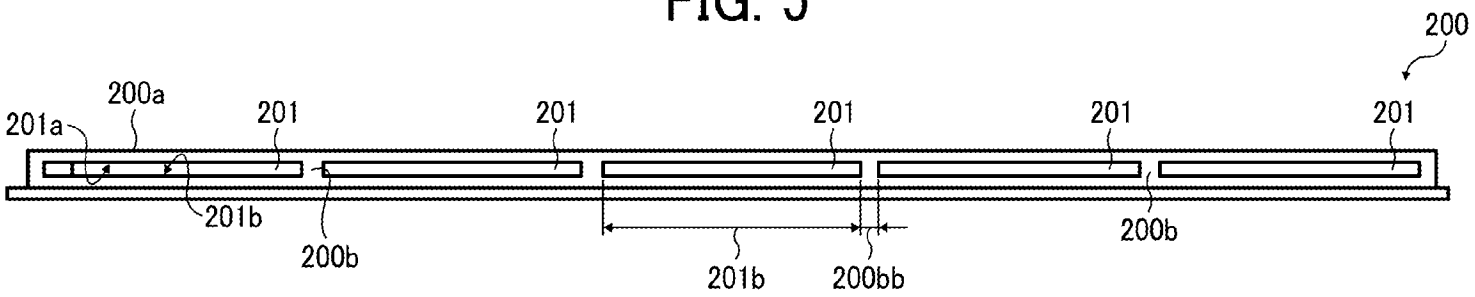
FIG. 5 is a front view illustrating a flicker included in the cleaning device of FIG. 4.
Figure 6:
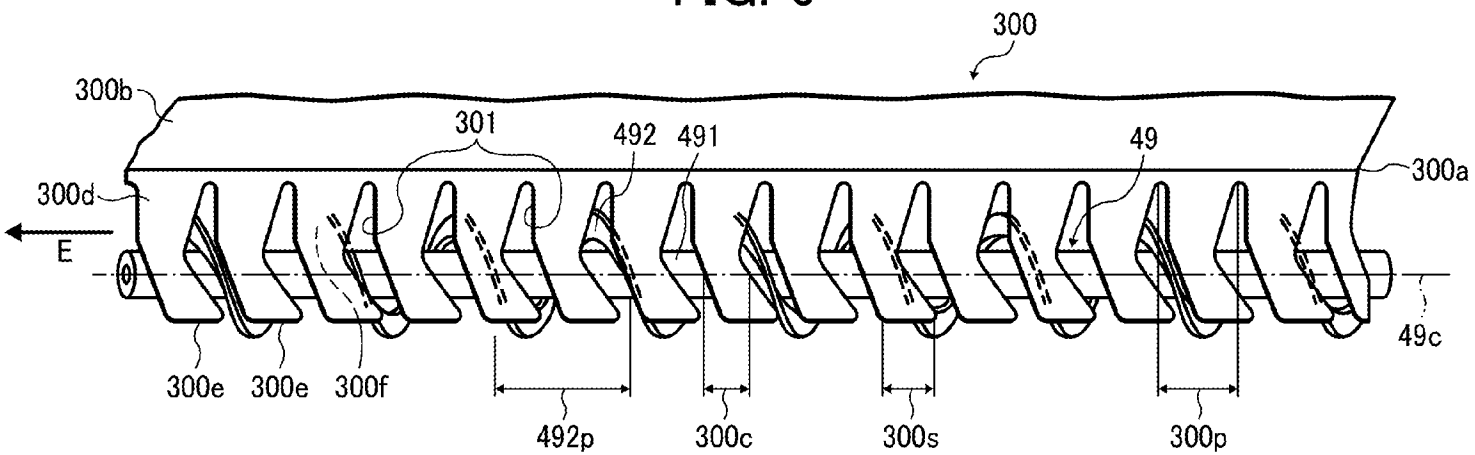
FIG. 6 is a perspective view illustrating an agitator and a toner conveying screw in a lateral direction, viewed from D of FIG. 4.

A description is given of the cleaning device 19 according to an embodiment, with reference to FIGS. 4 through 6.

FIG. 4 is an enlarged cross-sectional view illustrating a schematic configuration of the cleaning device 19 of FIG. 3. FIG. 5 is a front view illustrating the flicker 200 included in the cleaning device 19 of FIG. 4. FIG. 6 is a perspective view illustrating the agitator 300 and the toner conveying screw 49 in a lateral direction, viewed from a direction indicated by arrow D of FIG. 4. In FIG. 4, a direction indicated by bi-directional arrow Z represents a vertical direction (upward and downward).

It is to be noted that the cleaning brush 30, the metallic roller 32, and the flicker 200 are not illustrated in order to clarify a positional relation of the agitator 300 and the toner conveying screw 49.

As illustrated in FIG. 4, when the cleaning brush 30 contacts the metallic roller 32, each tip of the bristles 30*a* of the cleaning brush 30 or each leading area of the bristles 30*a* or each top of the bristles 30*a* (hereinafter, referred to as the "leading area of the bristles 30*a*) contacts the metallic roller 32 while being bent toward an upstream side in the rotation direction of the cleaning brush 30. Then, the leading area of the bristles 30*a* of the cleaning brush 30 backswings to its original posture by elastically changing the posture toward a downstream side in the rotation direction of the cleaning brush 30 as the leftmost bristle 30*a* illustrated in FIG. 4. This restoration of the posture of the bristle 30*a* causes a flicking to flick off the residual toner T attached to the leading area of the bristle 30*a* toward the same direction as a tangential line B indicated by broken arrow in FIG. 4. Specifically, the residual toner T removed by the cleaning brush 30 is mechanically flicked off in a direction of the tangential line B of an outer peripheral circle 130 rotating on the shaft 30*b* as a rotation center of the cleaning brush 30 at a contact area 500 of the cleaning brush 30 and the metallic roller 32 in FIG. 5.

As illustrated in FIG. 4, the flicker 200 is disposed upstream from a contact position of the cleaning brush 30 and the metallic roller 32 in the rotation direction of the cleaning brush 30 to contact the cleaning brush 30 in a direction from upstream to downstream of the rotation direction of the cleaning brush 30. The flicker 200 contacts and bites into the cleaning brush 30 to flick off toner, specifically toner having a reverse polarity and unstable toner, held on the cleaning brush 30.

A partition 190 is provided between the cleaning brush 30 and the toner conveying screw 49.

The reason why the flicker 200 is disposed upstream from the contact position of the cleaning brush 30 and the metallic roller 32 in the rotation direction of the cleaning brush 30 is to remove such the reversely charged toner and the unstable toner before the toner reaches the metallic roller 32. For example, if the flicker 200 is disposed downstream from the contact position of the cleaning brush 30 and the metallic roller 32 in the rotation direction of the cleaning brush 30, the reversely charged toner adhered to the cleaning brush 30 contacts the metallic roller 32 before the flicker 200 removes the toner mechanically. At this time, an appropriate bias to collect the reversely charged toner is not applied to the metallic roller 32. Therefore, the reversely charged toner cannot transport to the metallic roller 32. Consequently, the reversely charged toner may slidably contact between the metallic roller 32 and the cleaning brush 30, which is likely that the metallic roller 32 causes toner filming.

Further, the flicker 200 is a substantially L-shaped member in cross section and is disposed such that the flicker 200 bites into the cleaning brush 30. The flicker 200 has a length that is at least the same width as the cleaning brush 30 and extends in the axial direction of the cleaning brush 30 while maintaining a given bite amount in a width direction of the cleaning brush 30. Both ends of the flicker 200 are fixedly attached to the pair of sidewalk 194*a* and 194*b* (refer to FIG. 10). The pair of sidewalls 194*a* and 194*b* are also referred to as side frames included in the cleaning device 19.

The flicker 200 is a metal member such as stainless steel (SUS). According to this material, even though the flicker 200 contacts brush fiber for a relatively long period of time due to rotation of the cleaning brush 30, the flicker 200 is not worn out and can maintain sufficient durability. Specifically, the flicker 200 may include at least a metallic material that is provided over the entire length of the shaft 30*b* of the cleaning brush 30.

The flicker 200 includes multiple openings 201.

The cleaning brush 30, the metallic roller 32, and the toner conveying screw 49 are disposed such that a rotation center 30*c* of the cleaning brush 30 and a rotation center 49*c* of the toner conveying screw 49 are disposed lower than a rotation center 32*b* of the metallic roller 32. A lower end 201*b* of each of the openings 201 is located at a position between the cleaning brush 30 and the toner conveying screw 49 and at a substantially same height as the rotation center 49*c* of the toner conveying screw 49. The "substantially same height" corresponds to a position at a height within ±1 mm of the rotation center 49*c* of the toner conveying screw 49.

The flicker 200 includes the multiple openings 201 (five openings 201 in FIG. 5) along a width direction (a longitudinal direction) thereof, which is a left and right direction of the flicker 200 illustrated in FIG. 5 and an axial direction of the cleaning brush 30. The flicker 200 also includes multiple ribs 200*b* at given intervals so as not to be bent due to a rotation force of the cleaning brush 30. The five openings 201 of the flicker 200 are rectangular shaped. Each of the openings 201 has a width 201*b* of 64.9 mm and a height of approximately 4 mm. Each of the multiple ribs 200*b* has a width 200*bb* of 5 mm.

Further, an upper end 201*a* of each of the openings 201 is disposed such that the openings 201 bites into the cleaning brush 30 in a range of from about 1 mm to about 1.5 mm. According to this configuration, the fibers of the cleaning brush 30 contacts the upper end of the openings 201 due to rotation of the cleaning brush 30, so that adhesion of toner at the upper end 201*a* of each of the openings 201 can be prevented.

Further, a length from the upper end 201*a* of each of the openings 201 to an upper end 200*a* of the flicker 200 is about 2 mm. According to the configuration, the flicker 200 can function properly. Specifically, this configuration prevents degradation in a flicking force due to short of the length of the leading edge of the flicker 200 and shortfall of a desired bite amount of the flicker 200 due to a rotation force of the cleaning brush 30.

According to the present embodiment, by providing the flicker 200 at the position as described above, the reversely charged toner that is difficult to collect by the metallic roller 32 can be removed before the metallic roller 32 reliably. Further, by providing the multiple openings 201 to the flicker 200, airflow that is generated by rotation of the cleaning brush 30 is interrupted by the flicker 200 and the partition 190. This interruption increases pressure in the clearance 195, and therefore the toner does not travel back to the photoconductor drum 14. Consequently, toner dispersion outside the cleaning device 19 and image defect due to the toner dispersion can be prevented. As a result, the cleaning brush 30 is refreshed by the metallic roller 32 reliably.

Further, since the flicker 200 is disposed at the above-described position, the cleaning brush 30, the metallic roller 32, and the toner conveying screw 49 are disposed closely, and therefore the size of the cleaning device 19 can be reduced.

In addition, the flicker 200 having the multiple openings 201 prevents re-adhesion of the toner conveyed by the toner conveying screw 49 to the cleaning brush 30, thereby maintaining refreshed condition of the cleaning brush 30.

In FIGS. 4 and 6, the agitator 300 is formed of material of polyethylene terephthalate (PET) and has a thickness of 0.125 mm. The agitator 300 has a base end 300*b* that is fixed by a double-coated adhesive tape or the like to an agitator holder 310 that is manufactured through the sheet metal working process. The agitator holder 310 is screwed together with the metallic blade 35 with screws 43 at multiple portions of the attaching portion 192 of the cleaning device 19 on the container 191 side via the fixing member 142. That is, the agitator 300 is screwed together with the metallic blade 35 with screws 43 via the agitator holder 310 and the fixing member 142.

By attaching the agitator 300 not to the container 191 but via the agitator holder 310, assembly of the agitator 300 is enhanced and a limitation of a trajectory A formed by movement of edges 300*e* of the agitator 300 is reduced.

The agitator 300 has a free end 300*d* and a slideway 300*f*. The slideway 300*f* is a surface of the free end 300*d* to contact the toner conveying screw 49. As (the slideway 300*f* of) the free end 300*d* contacts the toner conveying screw 49, the agitator 300 vibrates due to rotation of the toner conveying screw 49. The trajectory A (illustrated with a dotted line in FIG. 4) is a movement path of the edges 300*e* that functions as a free edge of the agitator 300 and is set at a substantially same height as the lower end 201*b* of each opening 201 of the flicker 200. Specifically, the substantially same height as the lower end 201*b* corresponds to a height within a range of ±1 mm with respect to the lower end 201*b* of each opening 201 of the flicker 200.

The agitator 300 includes a bent portion 300*a*. Since the bent portion 300*a* of the agitator 300 is disposed at a substantially same height as the edge (a free edge) of the agitator holder 310, a center of vibration of the agitator 300 is the bent portion 300*a*.

It is to be noted that, in a case in which the agitator 300 is formed of material of PET, when the thickness of the agitator 300 is from 0.1 mm to 0.2 mm, test results have proved that an appropriate elasticity of the agitator 300 can provide the following effect(s).

As described above, the trajectory A (illustrated with a dotted line in FIG. 4) of the edges 300*e* of the vibrating agitator 300 is set at a substantially same height as the lower end 201*b* of each opening 201 of the flicker 200. According to this setting, the edges 300*e* of the agitator 300 contact the cleaning brush 30 and the flicker 200 other than the openings 201 of the flicker 200, so that a reciprocating movement or motion of the free end 300*d* of the agitator 300 cannot be restricted. Therefore, accumulation of toner at the openings 201 of the flicker 200 can be prevented.

The toner conveying screw 49 is formed of stainless steel (SUS). A drive shaft 491 is provided around the rotation center 49*c*. A spiral 492 is integrally provided along an extending direction (e.g., an axial direction) of the drive shaft 491. The toner conveying screw 49 guides the toner by rotation of the spiral 492 to the left side of FIG. 6, that is, in a toner discharging direction E.

Multiple cutouts 301 are provided to the free end 300*d* of the agitator 300 in a direction intersecting an axial direction of the toner conveying screw 49, from the edge 300*e* toward the belt portion 300*a*. The multiple cutouts 301 have an identical shape to each other over a width direction of the toner conveying screw 49 at intervals of a pitch 300*p*.

Vibration of the agitator 300 is generated due to contact of the agitator 300 with the toner conveying screw 49. Specifically, vibration of the agitator 300 is generated due to repetition of the following actions: rotation of the toner conveying screw 49 moves a contact position of the agitator 300 with the toner conveying screw 49 upward from the drive shaft 491 along the shape of the spiral 492; and then further rotation of the toner conveying screw 49 causes the agitator 300 to contact the drive shaft 491 again.

The vibration of the agitator 300 is generated in the vertical direction along the spiral 492 of the toner conveying screw 49, as described above. The movement path of the agitator 300 is illustrated as the trajectory A in FIGS. 4 and 8. When the agitator 300 moves, the free end 300*d* that is disposed facing the flicker 200 vibrates to a portion in the vicinity of the multiple openings 201 of the flicker 200. This vibration of the agitator 300 prevents the toner from blocking the multiple openings 201 and maintains the multiple openings 201 to be functional constantly. As a result, toner dispersion caused by toner blocking the multiple openings 201 and degradation of cleaning performance due to degradation of flicking performance of the flicker 200 can be prevented.

The pitch 300*p* between the adjacent cutouts 301 of the agitator 300 are different from the intervals of a pitch 492*p* of the spiral 492 of the toner conveying screw 49. Therefore, parts of the free end 300*d* of the agitator 300 disposed adjacent to each other with each cutout 301 therebetween have different vibration directions. Accordingly, the toner in the vicinity of the cutouts 301 are scraped off efficiently. Further, according to the above-described action of the parts of the free end 300*d* of the agitator 300, the toner between grooves of the spiral 492 can be scraped and removed.

Further, the edge 300*e* of each part formed between the adjacent cutouts 301 of the free end 300*d* of the agitator 300 has a width 300*s*, and a drive shaft contact portion where each part formed between the adjacent cutouts 301 of the free end 300*d* of the agitator 300 contacts the drive shaft 491 of the toner conveying screw 49 has a width 300*c*. The width 300*s* is formed greater (i.e., wider) than the width 300*c*. In other words, when the width 300*c* of the agitator 300 at the drive shaft contact portion (i.e., a portion where each part of the front end 300*d* of the agitator 300 contacts the rotation center 49*c* of the drive shaft 491) and the width 300*s* of the edge 300*e* of the agitator 300 are compared, the width 300*s* is greater than the width 300*c*. In the present embodiment, a distance of a gap between the adjacent parts of the free end 300*d* of the agitator 300 at the edges 300*e* having the width 300*s* is set to approximately 1 mm. Similarly, in the present embodiment, a distance of a gap between the adjacent parts of the free end 300*d* of the agitator 300 at the drive shaft contact portion having the width 300*c* is set to approximately 3 mm.

Accordingly, the toner does not accumulate at the agitator 300 in the vicinity of the drive shaft 491 and is discharged by the toner conveying screw 49 reliably. In addition, since the width 300*s* of the agitator 300 at the edge 300*e* is greater than the width 300*c* of the agitator 300 at the drive shaft contact portion, the toner accumulated in the vicinity of the edge 300*e* of the free end 300*d* of the agitator 300 can be scraped off without a gap in the width direction of the agitator 300. As a result, toner accumulation in the vicinity of the multiple openings 201 of the flicker 200 illustrated in FIG. 4 can be prevented reliably.

Here, a supplemental description of a toner collecting path and actions of toner removed by the flicker 200.

In FIG. 4, the flicker 200 is different from the cleaning brush 30 and the metallic roller 32 which are charged with respective voltages. Therefore, the flicker 200 mechanically flicks off the toner held by the cleaning brush 30 to remove the toner. The toner removed by the flicker 200 is flicked off to the metallic roller 32 or a portion between the metallic roller 32 and the toner conveying screw 49 by centrifugal force applied by rotation of the cleaning brush 30. The toner adhering to the metallic roller 32 is scraped off by the metallic blade 35 and discharged by the toner conveying screw 49. The toner flicked off to the portion between the metallic roller 32 and the toner conveying screw 49 falls on the toner conveying screw 49 by the force of gravity and is discharged by the toner conveying screw 49.

According to the configuration illustrated in FIG. 4, even if a part of collected toner collected to the toner conveying screw 49 to be wasted separates from an outer circumference of the toner conveying screw 49 by centrifugal force caused by counterclockwise rotation of the toner conveying screw 49 to cause toner dispersion, the metallic roller 32 in rotation can collect the part of toner. Concurrently, even if a part of collected toner collected and held by the metallic roller 32 separate from an outer circumference of the metallic roller 32, the toner conveying screw 49 that is disposed so as to overlap over a portion below the metallic roller 32 can collect and convey the part of toner.

As described above, the configuration of the present embodiment can prevent toner blocking in the cleaning device 19 including the multiple openings 201 of the flicker 200, which can prevent toner dispersion.

Further, by providing the flicker 200 at the above-described position, the reversely charged toner that is difficult to be collected by the metallic roller 32 can be removed reliably before reaching the metallic roller 32.

Figure 7:
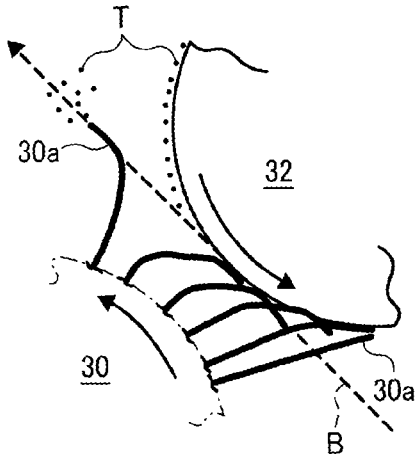
FIG. 7 is an enlarged front view illustrating movement of a cleaning brush at a contact portion of the cleaning brush and a metallic roller.
Figure 8:
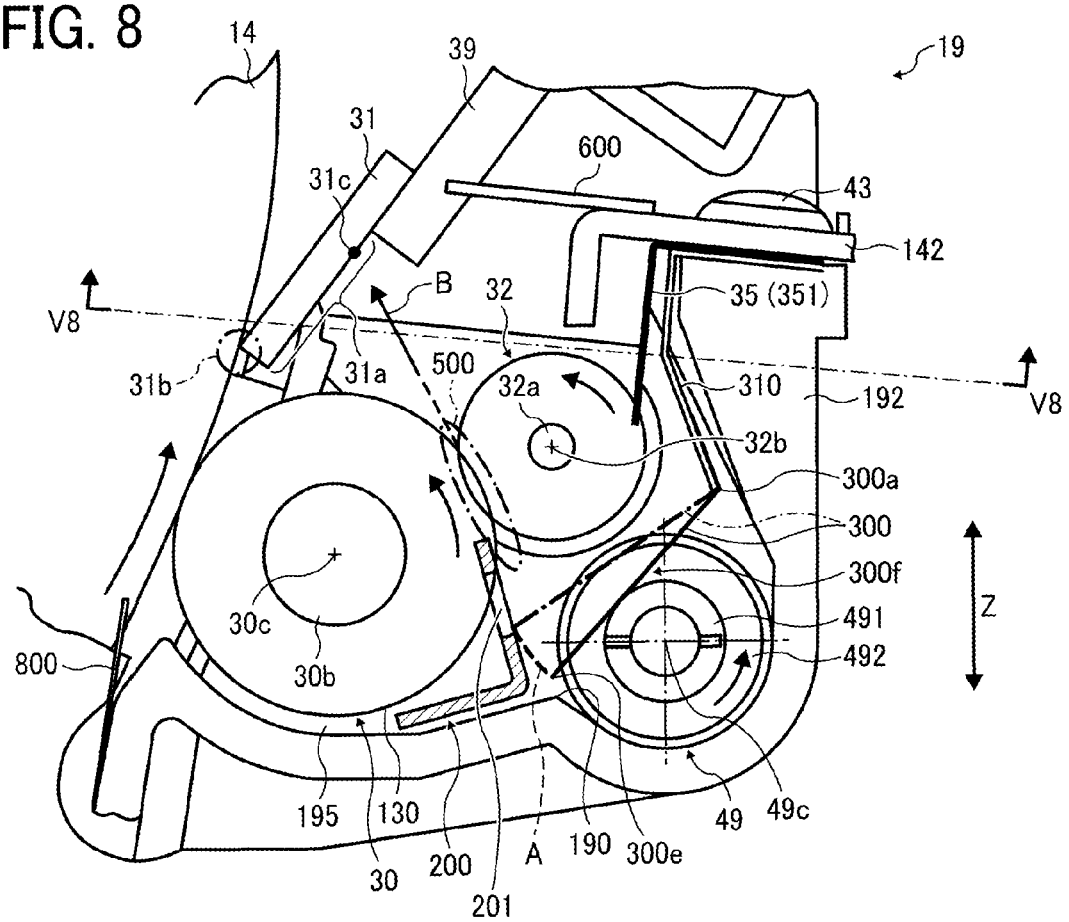
FIG. 8 is an enlarged cross-sectional view illustrating positions of the cleaning brush, the metallic roller, and a cleaning blade and a position of a seal.

A description is given of movement of the cleaning brush 30 at a portion in contact with the metallic roller 32 and a configuration of the cleaning brush 30, the metallic roller 32, and the cleaning blade 31, with reference to FIGS. 7 and 8.

FIG. 7 is an enlarged view illustrating the cleaning brush 30 and the metallic roller 32 to show how the bristle 30*a* of the cleaning brush 30 moves. FIG. 8 is an enlarged cross sectional view illustrating a positional configuration of the cleaning brush 30, the metallic roller 32, and the cleaning blade 31 and a position of a seal 600.

As illustrated in FIG. 7, when the cleaning brush 30 contacts the metallic roller 32, each tip of the bristles 30*a* of the cleaning brush 30 or each leading area of the bristles 30*a* or each top of the bristles 30*a* (hereinafter, referred to as the "leading area of the bristles 30*a*) contacts the metallic roller 32 while being bent toward an upstream side in the rotation direction of the cleaning brush 30. Then, the leading area of the bristles 30*a* of the cleaning brush 30 backswings to its original posture by elastically changing the posture toward a downstream side in the rotation direction of the cleaning brush 30 as the leftmost bristle 30*a* illustrated in FIG. 7. This restoration of the posture of the bristle 30*a* causes a flicking to flick off the residual toner T attached to the leading area of the bristle 30*a* toward the same direction as a tangential line B indicated by broken arrow in FIG. 7. Specifically, the residual toner T removed by the cleaning brush 30 is mechanically flicked off in a direction of the tangential line B of an outer peripheral circle 130 rotating on the shaft 30*b* as a rotation center of the cleaning brush 30 at a contact area 500 of the cleaning brush 30 and the metallic roller 32 in FIG. 8.

To address this inconvenience, the cleaning brush 30, the metallic roller 32, and the cleaning blade 31 are disposed such that the tangential line B has an intersection point 31*c* to intersect a non-contact surface 31*a* that is disposed opposite to a contact portion 31*b* of the cleaning blade 31 with the photoconductor drum 14, as illustrated in FIG. 8. Further, the tangential line B has the intersection point 31*c* closer to (the supporting bracket 39 of) the cleaning blade 31 than the contact position (i.e., the contact portion 31*b*) of the cleaning blade 31 with the photoconductor drum 14. According to this configuration, the particles of the residual toner T flicked off from the bristles 30*a* of the cleaning brush 30 are dispersed to an area of the non-contact surface 31 a of the cleaning blade 31.

In FIG. 8, the contact portion 31*b* of the cleaning blade 31 with the surface of the photoconductor drum 14 is surrounded by an ellipse indicated by a one-dot chain line.

The cleaning blade 31 is disposed in contact with the photoconductor drum 14. According to this configuration, the residual toner flicked off by the cleaning brush 30 toward the downstream side from the contact portion 31*b* in the rotation direction of the photoconductor drum 14 is no longer attracted to the photoconductor drum 14. Further, the intersection point 31*c* is separated away from the contact portion 31*b*. This configuration can prevent supply of a large amount of toner including the residual toner adhesion to the cleaning blade 31, and therefore does not adversely affect to wear of the cleaning blade 31.

Further, an almost full amount of residual toner flicked off in this region returns to the metallic roller 32 or the cleaning brush 30 along with the aid of gravity. After repeating the regular cleaning operation, the almost full amount of residual toner is collected to the waste toner conveying path. By contrast, the rest of residual toner adheres to the region of the non-contact surface 31*a* of the cleaning blade 31 and remains collected in the region without adversely affecting the image forming operations and the wear of the cleaning blade 31.

As described above, a center of the shaft 32*a* of the metallic roller 32 is disposed higher than a rotation center 30*c* of the cleaning brush 30 and the cleaning blade 31 is disposed above the rotation center 30*c* of the cleaning brush 30 in the vertical direction.

The present embodiment provides the above-described simple configuration in which the cleaning brush 30, the metallic roller 32, and the cleaning blade 31 are disposed such that the tangential line B has the intersection point 31*c* that intersects the non-contact surface 31*a* of the cleaning blade 31. According to the above-described operation in the present embodiment, even when the cleaning brush 30 and the metallic roller 32 rotate in the same direction, this configuration can prevent that the residual toner flicked off from the cleaning brush 30 adheres to the photoconductor drum 14 again and disperses to the outside of the image forming apparatus 100. Further, the life of the cleaning device 19 can be extended.

The above-described effects have been confirmed by conducting tests using the image forming apparatus 100 illustrated in FIG. 1, which is provided with the cleaning device 19 that includes the cleaning blade 31, the cleaning brush 30, the metallic roller 32, and the metallic blade 35 having the above-described respective specifications and characteristic values.

It is to be noted that, when the length of the cleaning blade 31 in a direction to contact with the photoconductor drum 14 is relatively short, a surface of the supporting bracket 39 can function as a replacement of the non-contact surface 31*a* of the cleaning blade 31 to achieve the effect of the present embodiment.

Figure 9A:
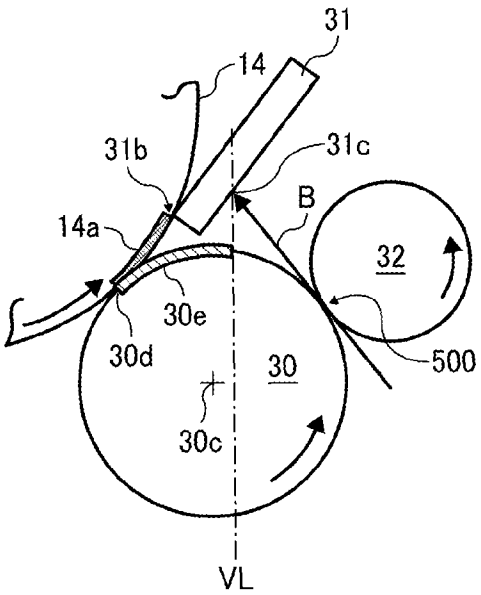
FIG. 9A is a diagram illustrating a structure in which a vertical line passing an intersection point is disposed closer to the metallic roller from a center of rotation of the cleaning brush.
Figure 9B:
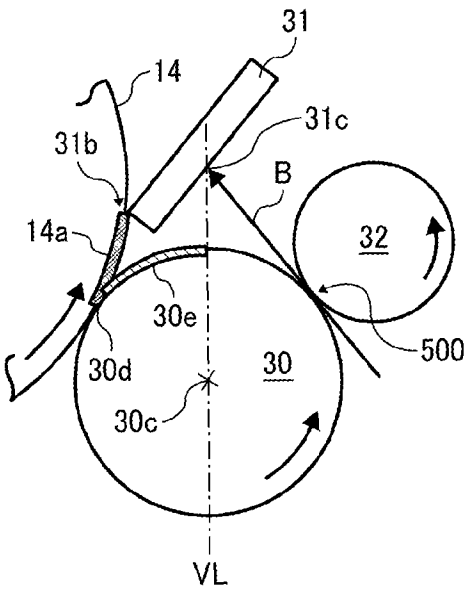
FIG. 9B is a diagram illustrating a structure in which the vertical line passing the intersection point is disposed to pass the center of rotation of the cleaning brush.
Figure 9C:
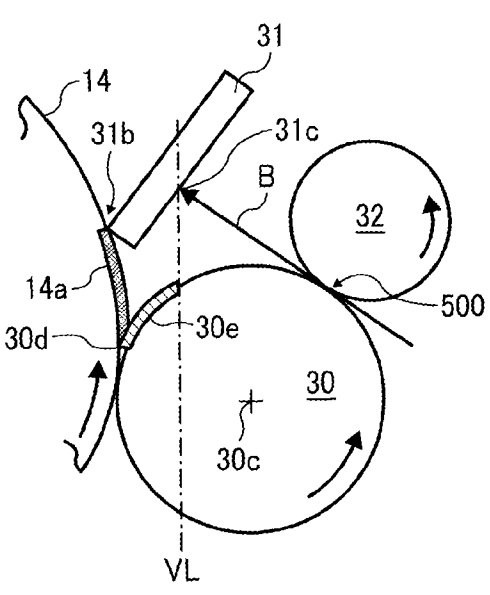
FIG. 9C is a diagram illustrating a structure in which the vertical line passing the intersection point is disposed closer to a photoconductor drum from the center of rotation of the cleaning brush.

A further description is given of the positions of the cleaning blade 31, the cleaning brush 30, and the metallic roller 32 with showing the positional relation of the intersection point 31*c* with respect to the tangential line B and the cleaning blade 31, with reference to FIGS. 9A through 9C. FIG. 9A illustrates an example configuration in which a vertical line VL indicated by a dot-dashed line passing through the intersection point 31*c* is located closer to the metallic roller 32 than the rotation center 30*c* of the cleaning brush 30. FIG. 9B illustrates an example configuration in which the vertical line VL passing through the intersection point 31*c* is located to pass through the rotation center 30*c* of the cleaning brush 30. FIG. 9C illustrates an example configuration in which the vertical line VL passing through the intersection point 31*c* is located closer to the photoconductor drum 14 than the rotation center 30*c* of the cleaning brush 30.

It is to be noted that preferable configurations among FIGS. 9A through 9C are the configurations with the positions of the vertical line VL illustrated in FIGS. 6A and 6B.

Apart of residual toner (hereinafter, also simply referred to as "toner") that is flicked off by the cleaning brush 30 and contacted with the cleaning blade 31 falls along with the aid of gravity or floats in the air. If the configuration of the cleaning device 19 is FIG. 9A or FIG. 9B, there is a distance from a position immediately below the intersection point 31*c* of the cleaning brush 30 to a minor arc 14*a* indicated by a bold line, which is a part of the outer circumferential surface of the photoconductor drum 14. The minor arc 14*a* indicates a part of the outer circumferential surface of the photoconductor drum 14 in a range of from a contact center 30*d* between the photoconductor drum 14 and the cleaning brush 30 to the contact portion 31*b* of the cleaning blade 31 with the photoconductor drum 14. From the above-described relation, a surface area of the cleaning brush 30 to which the toner falls from the photoconductor drum 14 or floats adheres again increases in FIGS. 9A and 9B. Here, the surface area of the cleaning brush 30 represents a surface area formed on the minor arc 30*e* of the outer circumferential surface of the cleaning brush 30 that is indicated as a hatched area expanding from the contact center 30*d* to the intersection point 31*c* at which the cleaning blade 31 intersects with the vertical line VL in FIGS. 9A through 9C. For this reason, the toner fell from the photoconductor drum 14 can adhere to a minor arc 30*e* of the cleaning brush 30 again and be collected easily, and therefore the toner is not likely to adhere to the minor arc 14*a* of the photoconductor drum 14.

By contrast, in the configuration illustrated in FIG. 9C, the toner that has fallen from the photoconductor drum 14 adheres to the minor arc 30*e* of the cleaning brush 30, which is the same as the configurations illustrated in FIGS. 9A and 9B. However, since the minor arc 14*a* of the photoconductor drum 14 is located close to the minor arc 30*e* of the cleaning brush 30, the toner can fall from the surface (formed by the leading areas of the bristles 30*a*) of the cleaning brush 30. Therefore, it is likely that the toner applies a load to the cleaning blade 31 disposed at the downstream side in the rotation direction of the photoconductor drum 14. Similarly, when the fallen toner floats, it is likely that the toner adheres to the minor arc 14*a* of the photoconductor drum 14.

As described above, in the present embodiment, the intersection point 31 c is set to be located within a region between a position where the vertical line VL is arranged closer to the metallic roller 32 than the rotation center 30*c* of the cleaning brush 30 and a position where the vertical line VL passes a crossing point of the rotation center 30*c* of the cleaning brush 30.

Figure 10:
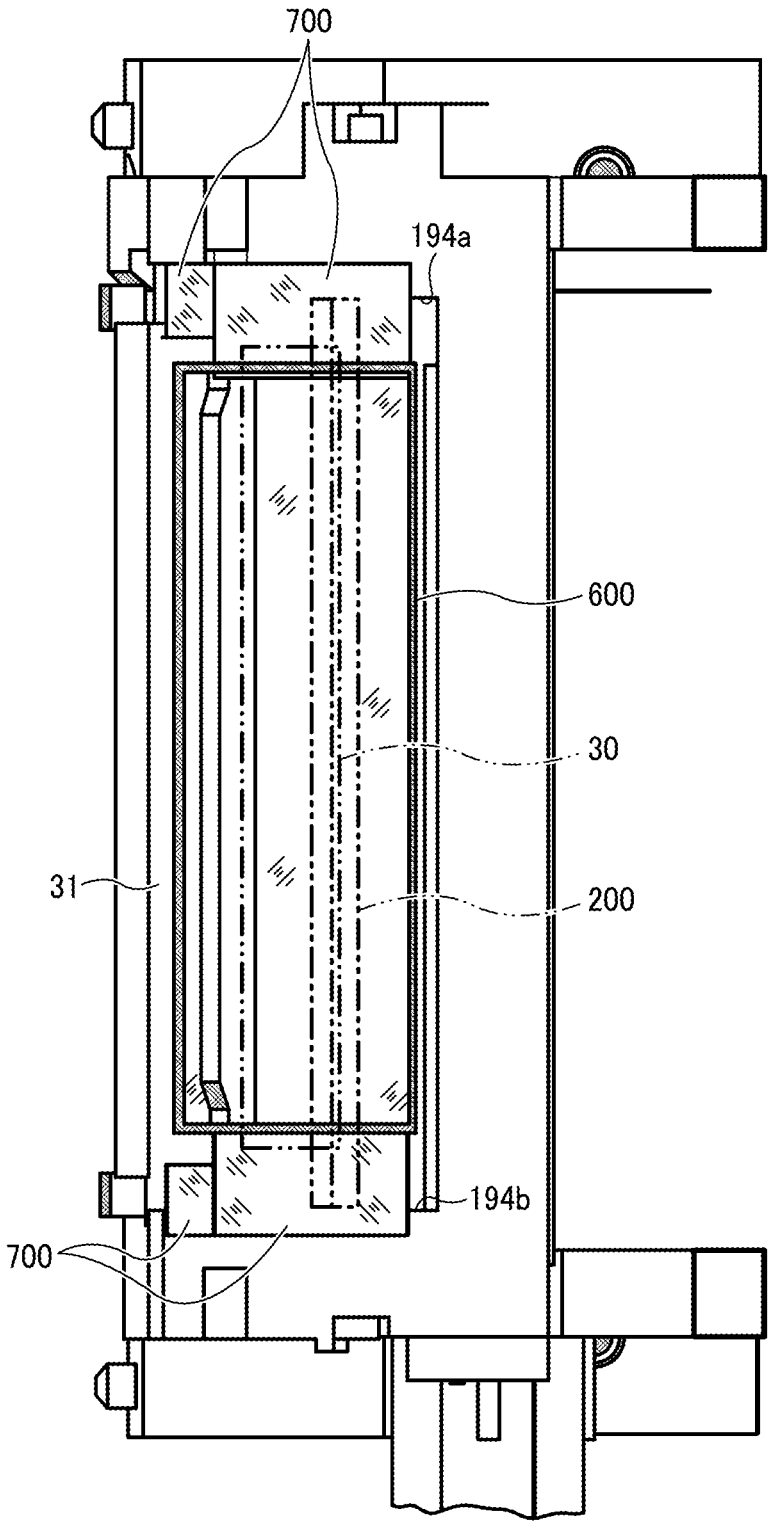
FIG. 10 is a partial cross-sectional bottom view illustrating the cleaning device including the seal, viewed from bottom along a line of V8-V8 of FIG. 8.

Next, a description is given of details of the seal 600 with reference to FIGS. 8 and 10.

FIG. 10 is a partial cross-sectional bottom view, viewing from bottom along a line V8-V8 of the cleaning device 19 of FIG. 8. In FIG. 10, a direction indicated by bi-directional arrow Z represents a vertical direction (upward and downward).

The seal 600 is a flexible member such as a PET film sheet including mylar. As illustrated in FIGS. 8 and 10, one end of the seal 600 is attached to an upper surface of the fixing member 142 disposed on the L-shaped metallic blade 35 and the other end (the free end) of the seal 600 is in contact with the supporting bracket 39 that functions as a blade supporting member of the cleaning blade 31. A tip or leading area of the other end (the free end) of the seal 600 contacts a surface of the supporting bracket 39 while being elastically bent downwardly along the surface of the supporting bracket 39. The seal 600 contacts extending over the whole length in a longitudinal direction of the photoconductor drum 14 and the cleaning blade 31. Further, the length in the longitudinal direction of the cleaning blade 31 is set longer than the length in the longitudinal direction of the seal 600.

It is to be noted that a virtual position of the cleaning brush 30 is illustrated with a two-dot chain line in FIG. 10 and that the length of the cleaning brush 30 in the longitudinal direction is set longer than the length of the seal 600 in the longitudinal direction. Further, the length of the cleaning blade 31 in the longitudinal direction is set to be equal to or longer than the length of the cleaning brush 30 in the longitudinal direction.

Side seals 700 are attached at both ends in the longitudinal direction of the seal 600. The side seals 700 are formed by a material different from the seal 600, which is, for example, formed polyurethane rubber or formed PUR so as to prevent toner dispersion from both edges in the longitudinal direction of the seal 600. One end of each side seal 700 is attached to the pair of sidewalls 194*a* and 194*b* integrally formed to both ends in the longitudinal direction of the container 191 and the other end thereof is overlaid on both ends in the longitudinal direction of the seal 600.

As described above, an open space above the cleaning brush 30, the metallic roller 32, and the metallic blade 35 in the container 191 are covered by the cleaning blade 31, the supporting bracket 39, the seal 600, and the side seals 700. Therefore, the seal 600 and the side seals 700 can prevent the residual toner flicked off by the cleaning brush 30 and floating in the open space from being leaked to the outside of the image forming apparatus 100.

It is to be noted that the fact that the cleaning brush 30, the metallic roller 32, and the metallic blade 35 are covered by the cleaning blade 31, the supporting bracket 39, and the seal 600 corresponds in the present embodiment to that the cleaning brush 30, the metallic roller 32, and the metallic blade 35 are substantially closed or sealed by the cleaning blade 31, the supporting bracket 39, and the seal 600. When a power source switch of the image forming apparatus 100 is on, the cleaning device 19 is operating, and therefore the charger 321 of FIG. 2 positively charges the metallic blade 35. When the cleaning device 19 is not operating, it is inferred that the contact portion between the photoconductor drum 14 and the cleaning brush 30 (specifically, an upstream portion of the contact portion in the rotation direction of the photoconductor drum 14) is open or has a gap so that air or the toner can pass therethrough. However, as illustrated in FIG. 3, while the cleaning device 19 is operating, it is regarded that the cleaning brush 30, the metallic roller 32, and the metallic blade 35 are substantially closed or sealed by the cleaning blade 31, the supporting bracket 39, and the seal 600, including the upstream portion of the contact portion between the photoconductor drum 14 and the cleaning brush 30 in the rotation direction of the photoconductor drum 14. This is because, while the cleaning device 19 is operating, the contact portion between the photoconductor drum 14 and the cleaning brush 30 can electrostatically restore the negatively charged toner by the positively charged multiple bristles 30*a*, and not toner but air can pass through the contact portion between the photoconductor drum 14 and the cleaning brush 30. Further, it is also because a seal 800 is disposed at the upstream portion of the contact portion between the photoconductor drum 14 and the cleaning brush 30 in the rotation direction of the photoconductor drum 14, as illustrated in FIG. 8, such that the seal 800 contacts the outer circumferential surface of the photoconductor drum 14. The seal 800 is formed of the same elastic member as the seal 600 and has a substantially same length as the cleaning blade 31 in the longitudinal direction thereof.

As described above, the above-described configuration according to the present embodiment can prevent toner blocking in the cleaning device 19 including the multiple openings 201 of the flicker 200, thereby preventing toner dispersion. Further, the above-described configuration according to the present embodiment can provide a process cartridge (i.e., the process cartridge 11) that can provide an effect by the cleaning device 19 and facilitate replacement of the cleaning device 19.

Next, a description is given of another configuration of a cleaning device as another example according to the present embodiment.

As a recent trend in developing products to reduce environmental impact, low-melting toner is typically used in a cleaning device that is used for electrophotographic image forming apparatuses, which has deteriorated toner flowability in the cleaning device. Due to this inconvenience, if the cleaning device does not include any toner conveying member other than a toner conveying screw, and toner particles adhere to each other and accumulates in the cleaning device to cause toner blocking due to toner cross-linking. This inconvenience can cause defect in conveying waste toner, and may result in product quality degradation.

In order to avoid this inconvenience, an agitator that is formed of a PET sheet is additionally attached to the toner conveying screw provided in the typical cleaning device. With this configuration, the agitator slides along an outer circumference of a screw coil to move in space outside a range of motion of the screw coil, and this movement of the agitator can prevent defect in conveying the toner.

By contrast, as the CPP (cost per page) of the electrophotographic image forming apparatus is reduced, higher durability of products is demanded. Similarly, the cleaning device is requested to have high durability of $5\times10^9$ or greater number of rotation of the screw coil.

Along with high durability of the cleaning device, the agitator is requested to have the same level of durability. However, when an agitator that is formed of the PET sheet having a thickness of about 0.1 mm slides on the toner conveying screw, a sliding part of a contact surface of the agitator is worn clue to friction. If this amount of abrasion continuously occurs, the sliding part breaks due to abrasion, and therefore the agitator cannot maintain a conveying function of waste toner.

In one configuration of a cleaning device, the toner conveying member rotates to contact and vibrate the agitator so as to prevent toner blocking. Accordingly, vibration of the agitator scrapes off the toner accumulated between adjacent conveying members, so that the toner cohesion, specifically toner blocking, is prevented. However, a service life of the agitator remains relatively short due to friction at the sliding part of the agitator and the toner conveying screw.

In order to address the above-described inconvenience, the configuration of a cleaning device 19A is provided as another example according to the present embodiment. With the cleaning device 19A included in the image forming apparatus 100, the durability of the agitator to prevent toner blocking is enhanced to provide a stable cleaning device over a long period of time.

A detailed description is given of the configuration of a cleaning device 19A as another example of the present embodiment.

Figure 11:
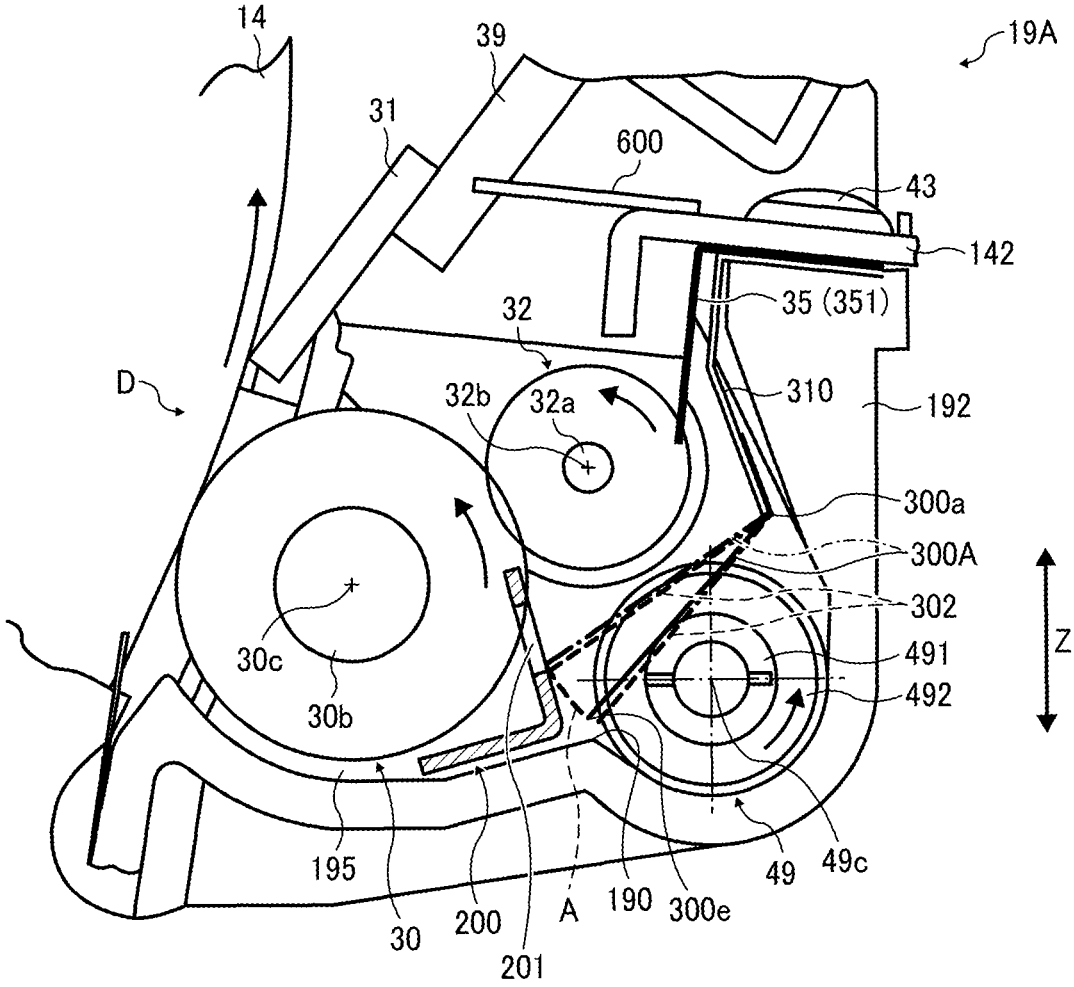
FIG. 11 is an enlarged cross-sectional view illustrating another cleaning device according to an embodiment.
Figure 12A:
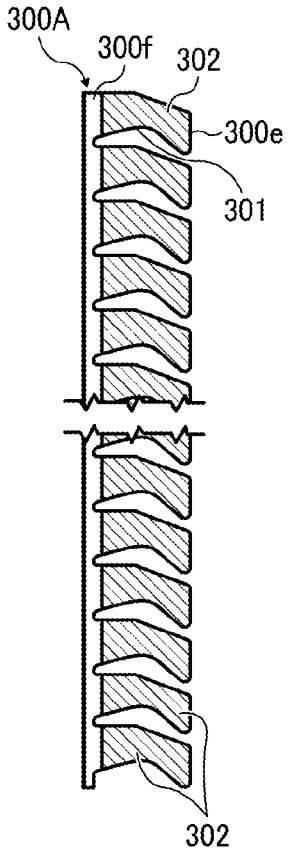
FIG. 12A is a back view illustrating a high density polyethylene sheet is attached on a slidable surface of the agitator.
Figure 12B:
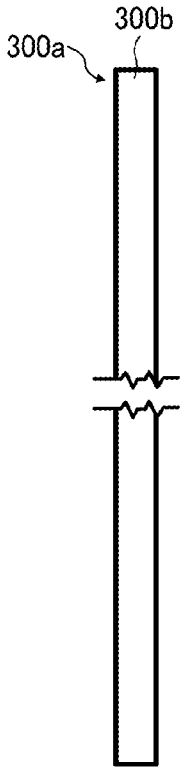
FIG. 12B is a plan view illustrating the agitator of FIG. 12A.
Figure 12C:
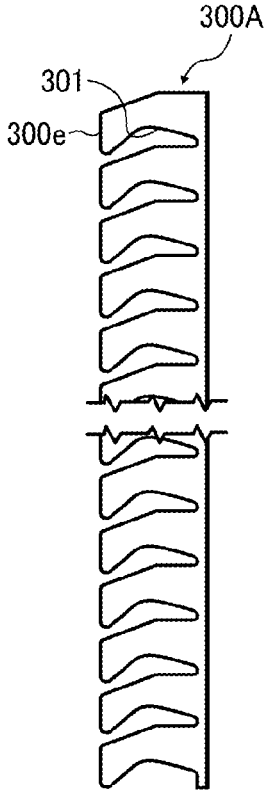
FIG. 12C is a right side view illustrating the agitator of FIG. 12A.
Figure 12D:
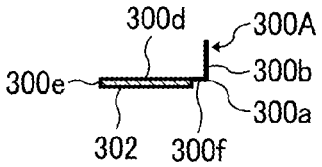
FIG. 12D is a front cross-sectional view illustrating the agitator of FIG. 12C.
Figure 13:
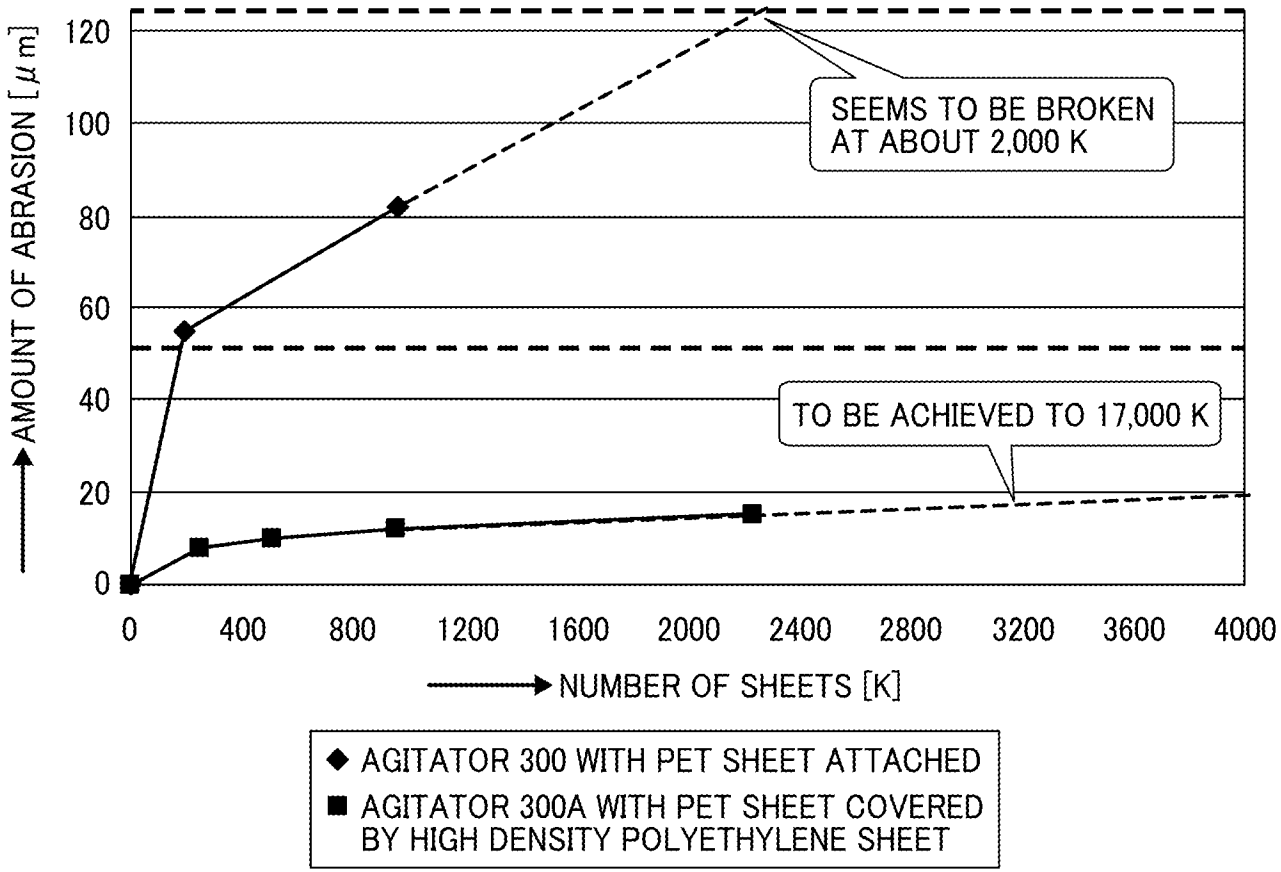
FIG. 13 is a graph showing test results of abrasion of different agitators according to the present embodiment.

FIG. 11 is an enlarged cross sectional view illustrating the configuration of the cleaning device 19A as another example according to the present embodiment. FIG. 12A is a back view illustrating a high density polyethylene sheet is attached on the slideway 300*f* of the agitator 300. FIG. 12B is a plan view illustrating the agitator 300 of FIG. 12A. FIG. 12C is a right side view illustrating the agitator 300 of FIG. 12A. FIG. 12D is a front cross sectional view illustrating the agitator 300A of FIG. 12C. FIG. 13 is a graph showing test results of abrasion on a slideway of the agitator 300 that is formed of the PET sheet (refer to FIGS. 4 and 6) and abrasion on the slideway 300*f* of the agitator 300A with a high density polyethylene sheet attached, according to the configuration of example of the present embodiment (refer to FIGS. 11 and 12).

The cleaning device 19A illustrated in FIG. 11 is different from the cleaning device 19 illustrated in FIG. 4 in that the cleaning device 19A includes an agitator 300A. The agitator 300A is basically identical to the agitator 300, except that a high density polyethylene sheet 302 is attached and fixed to the slideway 300*f* where the agitator 300A contacts the toner conveying screw 49. Except for the agitator 300A, the configuration and functions of the cleaning device 19A are identical in the cleaning device 19, the process cartridge 11, and the image forming apparatus 100. The high density polyethylene sheet 302 is a sheet having a high durability that is formed of a material different from the agitator 300.

As illustrated in FIG. 12A, the high density polyethylene sheet 302 is attached and fixed to the agitator 300A, which is formed of a PET material, on the side of the slideway 300*f* that is the contact surface with the toner conveying screw 49, and has the same shape as the agitator 300A formed of the PET material. The agitator 300A is actually manufactured by a method in which the high density polyethylene sheet 302 is attached, specifically glued, to the agitator 300A that has the PET sheet as a base member and then the sheet is die-cut to form the agitator 300A integrally.

The agitator 300A has the same shape as the agitator 300 in FIGS. 4 and 6 and includes the PET sheet having a thickness of 0.125 mm. The high density polyethylene sheet 302 in the present example has a thickness of 50 μm. However, a high density polyethylene sheet having a thickness of about 30 μm to about 200 μm can also be applied. The high density polyethylene sheet 302 has relatively high wear resistance among different high wear resistance sheets. Further, the high density polyethylene sheet 302 is good in cost performance and attachment operability.

A description is given of the test results of abrasion of different types of agitators with reference to a graph of test results shown in FIG. 13.

A vertical axis of the graph of FIG. 13 indicates respective amounts of abrasion of the agitator 300 and an agitator 300A according to the present embodiment. The agitator 300 includes a PET sheet having 125 μm in thickness (illustrated in a bold dotted line) attached thereto. The agitator 300A includes a PET sheet covered by a high density polyethylene sheet 302 having 50 μm in thickness (illustrated in another bold dotted line). A horizontal axis of the graph of FIG. 13 indicates the number of sheets used for image forming in the image forming apparatus 100 illustrated in FIG. 1, which corresponds to an operation time of the toner conveying screw 49.

The test was conducted using an assembly unit of FIG. 4 including the toner conveying screw 49 and the agitator 300 and an assembly unit of FIG. 11 including the toner conveying screw 49 and the agitator 300A with the high density polyethylene sheet 302 attached thereto under the same conditions. Specifically, both assemblies were tested by rotating the identical toner conveying screw 49 that is formed by a stainless steel (SUS) driven by an identical drive motor for a period of time that corresponds to the number of sheets or recording media for image forming by the image forming apparatus 100 of FIG. 1. Under these conditions, data of respective amounts of abrasion of the agitators was obtained.

This ongoing test shown in FIG. 13 has derived the gradients indicated by the respective dotted lines from respective changes of amounts of abrasion of the agitator 300 and the agitator 300A at this stage and has estimated whether or not there will be any break or damage on the agitator 300 and the agitator 300A when the considerable number of sheets or recording media (in a unit of 1,000 or K) are printed. As can be seen from the interim results of the test data shown in FIG. 13, the agitator 300A illustrated in FIGS. 11 through 12C can achieve a more significant reduce in abrasion speed than the agitator 300 illustrated in FIGS. 4 and 6. Therefore, the agitator 300A can be expected to provide a stable operation over a relatively long period of time.

As described in the present example, the agitator 300A is formed of the PET material and attached with a wear resistance sheet or tape of, for example, high density polyethylene material overlaying the PET material on the slideway 300*f* where the free end 300*d* of the agitator 300A contacts the toner conveying screw 49. By so doing, the amount of abrasion of the slideway 300*f* of the agitator 300A is significantly reduced as shown in the test data of FIG. 13. Consequently, the function of the agitator 300A can be maintained over a long period of time.

Even if the wear resistance sheet or tape of high density polyethylene material is employed as an agitator that is formed of a PET material, the function of the agitator cannot be maintained. Since the agitator is provided to prevent toner blocking by agitating accumulated toner with rigidity of the agitator by rotating the toner conveying screw, the agitator may need to employ a material having a certain rigidity such as a PET material. By contrast, a resin sheet having high wear resistance such as high density polyethylene has low rigidity. Therefore, even if a single material having low rigidity forms the agitator, a sufficient force to agitate the toner cannot be generated, and therefore the agitator formed of the single low-rigidity material cannot prevent toner blocking. As a result, it is preferable that the high density polyethylene sheet or a high density polyethylene film having a high wear resistance is used to overlay on the PET sheet or a PET film that can properly work as an agitator at the sliding part of the agitator with respect to the toner conveying screw. Accordingly, good balance between functional maintenance and high durability can be achieved.

In this example, the agitator 300A is provided with the high density polyethylene sheet 302 attached thereto. However, the structure of the agitator 300A is not limited thereto. For example, the agitator 300A may have a polytetrafluoroethylene (PTFE) sheet attached and fixed thereto or fluoropolymers that is a wear resistance material different from the agitator 300A coated over the sliding surface thereof. It is to be noted that the material of the toner conveying screw 49 is not limited to stainless steel (SUS) but can be a suitable resin material, so that the above-described effects can be achieved.

As described above, the configuration as another example can extend a service life of the agitator 300 that can prevent toner blocking in the cleaning device 19A, and therefore a stable operation over a long period of the cleaning device 19A.

It is to be noted that the cleaning member includes at least one of a brush rotary body and a cleaning blade member.

The method of the primary transfer of the image forming apparatus 100 is not limited to an indirect transfer method as described in the above-described configuration in which the toner images are primarily transferred onto the intermediate transfer belt 52. For example, a configuration that employs a direct transfer method by which the toner images are directly transferred onto a recording medium can also be applied to the image forming apparatus 100.

Further, the present embodiment describes a configuration in which the photoconductor drum 14 includes the cleaning devices 19 and 19A. However, the configuration of a cleaning device is not limited thereto. For example, a cleaning device according to the present embodiment can be provided to the intermediate transfer belt 52.

Regarding an intermediate transfer member, the present embodiment employs the intermediate transfer belt 52 having an endless loop as described above. However, an intermediate transfer member is not limited to the above-described belt-shaped member. For example, a drum-shaped intermediate transfer member can be applied to a configuration according to an embodiment.

Regarding an image carrier, the present embodiment employs the photoconductor drum 14 as described above. However, an image carrier is not limited to the above-described drum-shaped image carrier. For example, a belt shaped image carrier having an endless loop can be applied to a configuration according to an embodiment of the present invention.

The above-described embodiments are illustrative and do not limit the disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure may be practiced otherwise than as specifically described herein.

What is claimed is:

1. A cleaning device comprising:

a cleaning member including a brush rotary body that is disposed in contact with an image carrier provided in an image forming apparatus and that removes toner on the image carrier and holds the toner thereon;

a toner conveying rotary body to collect and convey the toner removed by the cleaning member;

a flicker contacting the cleaning member to flick off the toner held on the cleaning member and having an opening; and an agitator that has a free end contacting the toner conveying rotary body and vibrating due to rotation of the toner conveying rotary body and has a trajectory being formed between the opening and the toner conveying rotary body by movement of the free end thereof.

2. The cleaning device according to claim 1, wherein the opening of the flicker includes multiple openings disposed in an axial direction of the cleaning member.

3. The cleaning device according to claim 1, wherein an end of the opening bites into the cleaning member.

4. The cleaning device according to claim 1, wherein the flicker is disposed to contact the cleaning member in a direction from upstream to downstream of a rotation direction of the cleaning member.

5. The cleaning device according to claim 1, wherein the agitator has multiple cutouts in a direction intersecting an axial direction of the toner conveying rotary body, wherein the toner conveying rotary body has a drive shaft, wherein the free end of the agitator has multiple parts, each of which is formed between adjacent cutouts of the multiple cutouts, wherein a first width of each of the multiple parts of the free end of the agitator at an edge of the free end is greater than a second width of each of the multiple parts of the free end of the agitator at a contact portion where each of the multiple parts contacts the drive shaft of the toner conveying rotary body.

6. The cleaning device according to claim 1, wherein the agitator includes a sliding surface that contacts the toner conveying rotary body, wherein the sliding surface of the agitator is either attached with a wear resistance sheet different from a material of the agitator or coated with a wear resistance material different from the material of the agitator.

7. A process cartridge detachably attachable to an apparatus body of an image forming apparatus, the process cartridge integrally comprising:

the cleaning device according to claim 1; and at least one of the image carrier to form an image on a surface thereof;

a charger to uniformly charge the image carrier; and a development device to develop the image on the image carrier charged by the charger.

8. An image forming apparatus comprising:

an image forming device to form an image on a recording medium; and the cleaning device according to claim 1 included in the image forming device.

9. A cleaning device comprising:

a cleaning member including a brush rotary body that is disposed in contact with an image carrier provided in an image forming apparatus and that removes toner on the image carrier and holds the toner thereon;

a toner conveying rotary body to collect and convey the toner removed by the cleaning member;

a flicker contacting the cleaning member to flick off the toner held on the cleaning member; and an agitator that has a free end contacting the toner conveying rotary body and vibrating due to rotation of the toner conveying rotary body, the free end being disposed facing the flicker.

10. The cleaning device according to claim 9, further comprising:

a toner collecting rotary body disposed in contact with the brush rotary body and collecting the toner held on the brush rotary body; and a toner scraping member disposed in contact with the toner collecting rotary body and scraping the toner adhered to the toner collecting rotary body, wherein the toner scraping member and the agitator are screwed together.

11. The cleaning device according to claim 9, further comprising:

a toner collecting rotary body disposed in contact with the brush rotary body and collecting the toner held on the brush rotary body; and a toner scraping member disposed in contact with the toner collecting rotary body and scraping the toner adhered to the toner collecting rotary body, wherein the flicker, the agitator, and a rotation center of the toner collecting rotary body are disposed between a rotation center of the cleaning member and a rotation center of the toner conveying rotary body, wherein the rotation center of the toner collecting rotary body is disposed above the flicker and the agitator.

12. The cleaning device according to claim 10, wherein the toner scraping member and the agitator are screwed together and disposed above the toner collecting rotary body.

13. The cleaning device according to claim 9, wherein the flicker is disposed to contact the cleaning member in a direction from upstream to downstream of a rotation direction of the cleaning member.

14. A process cartridge detachably attachable to an apparatus body of an image forming apparatus, the process cartridge comprising:

the cleaning device according to claim 9; and at least one of the image carrier to form an image on a surface thereof;

a charger to uniformly charge the image carrier; and a development device to develop the image on the image carrier charged by the charger.

15. An image forming apparatus comprising:

an image forming device to form an image on a recording medium; and the cleaning device according to claim 9 included in the image forming device.

16. A cleaning device comprising:

a cleaning member to remove toner on an image carrier provided in an image forming apparatus and to clean a surface of the image carrier;

a toner conveying rotary body to collect and convey the toner removed by the cleaning member; and an agitator that contacts the toner conveying rotary body and vibrates due to rotation of the toner conveying rotary body, wherein the agitator includes a sliding surface that contacts the toner conveying rotary body, wherein the sliding surface of the agitator is either attached with a wear resistance sheet different from a material of the agitator or coated with a wear resistance material different from the material of the agitator.

17. The cleaning device according to claim 16, wherein the wear resistance sheet different from the material of the agitator is a high density polyethylene sheet.

18. The cleaning device according to claim 16, wherein a portion of the agitator that is either attached with the wear resistance sheet or coated with the wear resistance material has multiple cutouts in a direction intersecting an axial direction of the toner conveying rotary body.

19. A process cartridge detachably attachable to an apparatus body of an image forming apparatus, the process cartridge comprising:

the cleaning device according to claim 16; and at least one of the image carrier to form an image on a surface thereof;

a charger to uniformly charge the image carrier; and a development device to develop the image on the image carrier charged by the charger.

20. An image forming apparatus comprising:

an image forming device to form an image on a recording medium; and the cleaning device according to claim 16 included in the image forming device.

* * * * *